US009576527B2

(12) United States Patent
Han

(10) Patent No.: US 9,576,527 B2
(45) Date of Patent: Feb. 21, 2017

(54) ORGANIC LIGHT EMITTING DIODE DISPLAY AND DRIVING METHOD THEREOF

(71) Applicant: Samsung Display Co., LTD., Yongin, Gyeonggi-do (KR)

(72) Inventor: Sang-Myeon Han, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 585 days.

(21) Appl. No.: 13/971,625

(22) Filed: Aug. 20, 2013

(65) Prior Publication Data

US 2014/0307010 A1 Oct. 16, 2014

(30) Foreign Application Priority Data

Apr. 12, 2013 (KR) ..... 10-2013-0040654

(51) Int. Cl.
*G09G 3/32* (2016.01)
*G09G 3/00* (2006.01)

(52) U.S. Cl.
CPC ..... *G09G 3/3233* (2013.01); *G09G 3/003* (2013.01); *G09G 2300/0814* (2013.01); *G09G 2300/0819* (2013.01); *G09G 2300/0852* (2013.01); *G09G 2300/0866* (2013.01); *G09G 2310/0216* (2013.01); *G09G 2310/063* (2013.01); *G09G 2320/043* (2013.01)

(58) Field of Classification Search
CPC ..... G09G 3/3208; G09G 3/3233; G09G 2320/0209
See application file for complete search history.

(56) References Cited

U.S. PATENT DOCUMENTS

2012/0050274 A1* 3/2012 Yoo ..... G09G 3/003 345/419

FOREIGN PATENT DOCUMENTS

| | | | |
|---|---|---|---|
| KR | 10-2011-0013693 | A | 2/2011 |
| KR | 10-2011-0042515 | A | 4/2011 |
| KR | 10-2012-0065139 | A | 6/2012 |
| KR | 10-2012-0129335 | A | 11/2012 |

* cited by examiner

*Primary Examiner* — Amare Mengistu
*Assistant Examiner* — Sarvesh J Nadkarni
(74) *Attorney, Agent, or Firm* — Lewis Roca Rothgerber Christie LLP

(57) ABSTRACT

An organic light emitting diode display includes a plurality of pixels configured to store a first data signal received through a corresponding data line during a scan period and to emit light according to a second data signal during a light emitting period of a frame, wherein the first data signal corresponds to the frame and the second data signal corresponds to a previous frame, and the scan period overlaps the light emitting period.

18 Claims, 19 Drawing Sheets

ORGANIC LIGHT EMITTING DIODE DISPLAY AND DRIVING METHOD THEREOF

CROSS-REFERENCE TO RELATED APPLICATION

This application claims priority to and the benefit of Korean Patent Application No. 10-2013-0040654 filed in the Korean Intellectual Property Office on Apr. 12, 2013, the entire contents of which are incorporated herein by reference.

BACKGROUND

1. Field

Embodiments of the present invention relate to a technology associated with an organic light emitting diode display and a driving method thereof.

2. Description of the Related Art

A display device is used as a display device of a personal computer, portable phone, or personal digital assistant (PDA) or a monitor of various information devices, and an LCD using a liquid crystal panel, an organic light emitting diode display using an organic light emitting diode, and a PDP using a plasma panel may be used as the display device. Among them, the organic light emitting diode display, which has an excellent emission efficiency, luminance, and viewing angle, and a fast response speed, has been spotlighted.

The organic light emitting diode display has a display area including a plurality of pixels on a substrate in a matrix form, and is configured to provide a display by connecting a scan line and a data line to each pixel and selectively applying a data signal to the pixel.

The organic light emitting diode displays may be divided into a passive matrix type and an active matrix type. The passive matrix type refers to a type driven by forming positive electrodes and negative electrodes which cross each other and supplying data to selected lines.

The active matrix type refers to a type which maintains a data signal switched by a switching transistor in a capacitor and which applies the data signal to a driving transistor so as to control a current flowing in an organic light emitting diode.

FIG. 1 is a diagram for describing a method of driving an organic light emitting diode display in a general active matrix type.

Referring to FIG. 1, one frame comprises sub-frames of a left-eye image section (or period) LI and a right-eye image section (or period) RI to display a stereoscopic image. The left-eye image section LI comprises a scan section (or period) LN1 for inputting (or writing) left-eye image data and a light emitting section (or period) LE1 in which light is emitted according to the input left-eye image data. Further, the right-eye image section RI also comprises a scan section (or period) RN1 for inputting (or writing) right-eye image data and a light emitting section (or period) RE1 which emits light in which light is emitted according to the input right-eye image data.

As described above, at least each scan period and each light emitting period are required to express the left-eye image and the right-eye image for one frame (60 Hz), so that each of the sections should be processed at a speed of ¼ frame (240 Hz).

Further, with respect to all of the pixels of the display panel, the scan period and the light emitting period are separated from each other. When an image is concurrently (e.g., simultaneously) displayed across all of the pixels during the light emitting period, it may be advantageous to improve a motion blur phenomenon or implement a stereoscopic image. However, it is difficult to express accurate luminance because the light emitting period is limited to a half frame or shorter.

Accordingly, even not in a case of the driving of the stereoscopic image, light emitting luminance should be maximally increased to secure average luminance, thereby increasing a power voltage and power consumption. Further, because a driving current is also increased when the light is emitted, non-uniformity in the luminance due to a voltage drop (IR drop) may also be relatively increased.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention are directed to providing an organic light emitting diode display including a pixel which is suitable for a large sized display panel and for the expression of a high resolution and a stereoscopic image, the pixel having a sufficient aperture ratio, and a driving method thereof.

An exemplary embodiment of the present invention provides an organic light emitting diode display including: a plurality of pixels configured to store a first data signal received through a corresponding data line during a scan period and to emit light according to a second data signal during a light emitting period of a frame, wherein the first data signal corresponds to the frame and the second data signal corresponds to a previous frame, and the scan period overlaps the light emitting period, each of the plurality of pixels including a first transistor configured to connect the data line and a first node; a sustain capacitor coupled between the first node and a reference voltage applying line; a third transistor configured to connect the first node and a second node; a driving transistor and an organic light emitting diode connected in series between first and second power voltage applying lines; a compensation capacitor connected between the second node and a gate electrode of the driving transistor; a second transistor configured to connect the sustain capacitor and the reference voltage applying line; and a fourth transistor configured to transmit a bias voltage to the second node.

The first data signal may be a data signal at a first time or a data signal at a second time corresponding to the frame, the second data signal may be an image data signal at a first time or an data signal at a second time corresponding to the previous frame, and the times of the first data signal and the second data signal may be different from each other.

The one frame may include an initialization period during which a drain electrode of the driving transistor is reset and initialized; a compensation period during which a threshold voltage of the driving transistor is compensated for; the scan period during which a voltage corresponding to the first data signal is stored in the sustain capacitor when a scan signal is applied through a scan line coupled to a pixel of the pixels; the light emitting period during which the organic light emitting diode emits light according to a driving current corresponding to the second data signal when the bias voltage is applied to the second node; and a bias period during which the driving transistor is driven according to the bias voltage.

The sustain capacitor may be configured to store the voltage corresponding to the first data signal from the scan period of the previous frame until the initialization period of the frame.

The third transistor may be configured to transmit the voltage stored in the sustain capacitor to the compensation capacitor during the compensation period. The first transistor may be configured to electrically disconnect the data line and the first node during the compensation period.

The second transistor may be configured to connect the sustain capacitor and the reference voltage applying line during the compensation period and the scan period. The sustain capacitor may be connected between the first node and the third transistor.

The sustain capacitor may be connected between the second transistor and the reference voltage applying line. The compensation capacitor may be configured to store the voltage corresponding to the second data signal from the compensation period of the previous frame until the initialization period of the frame.

The fourth transistor may be configured to connect the second node and the first power voltage applying line when the first power voltage and the second power voltage are applied with a first level during the initialization period.

The fourth transistor may be configured to connect the second node and the reference voltage applying line when the first power voltage and the second power voltage are applied with a first level during the initialization period.

The fourth transistor may be configured to block transmission of the bias voltage to the second node during the compensation period. Each of the plurality of pixels may further include a fifth transistor configured to diode-connect a gate electrode and a drain electrode of the driving transistor when the first power voltage and the second power voltage are applied with the first level during the initialization period.

The fifth transistor may be configured to diode-connect the gate electrode and the drain electrode of the driving transistor when the first power voltage and the second power voltage are applied with a second level higher than the first level during the compensation period.

The fifth transistor may be configured to diode-connect the gate electrode and the drain electrode of the driving transistor when the first power voltage and the second power voltage are applied with a second level during the bias period.

The first and third transistors may be configured to be turned on, the fourth transistor may be configured to be turned off, and the bias voltage may be transmitted to the second node through the data line during the bias period.

Another exemplary embodiment of the present invention provides, a method of driving an organic light emitting diode display including a plurality of pixels each including a first transistor configured to connect a data line and a first node, a sustain capacitor connected between the first node and a reference voltage applying line, a third transistor configured to connect the first node and a second node, a driving transistor and an organic light emitting diode connected in series between first and second power voltage applying lines, a compensation capacitor connected between the second node and a gate electrode of the driving transistor, a second transistor configured to connect the sustain capacitor and the reference voltage applying line, and a fourth transistor configured to transmit a bias voltage to the second node, the method including: storing a first data signal corresponding to a frame in the sustain capacitor during a scan period; and emitting light from the organic light emitting diode in accordance with a second data signal corresponding to a previous frame during a light emitting period, wherein the scan period and a light emitting period occur concurrently.

The method may further include resetting and initializing a drain electrode of the driving transistor; compensating for a threshold voltage of the driving transistor; and driving the driving transistor according to the bias voltage.

Emitting the light may include emitting the organic light emitting diode with the driving current corresponding to a voltage stored in the compensation capacitor when the first power voltage or the reference voltage is transmitted to the second node.

According to the exemplary embodiments of the present invention, it is possible to make a large sized display panel and stably display a high resolution and stereoscopic image, and accordingly improve a display quality of a display device.

BRIEF DESCRIPTION OF THE DRAWINGS

FIG. 3 is a timing diagram illustrating a method of driving an organic light emitting diode display according to an exemplary embodiment of the present invention.

DETAILED DESCRIPTION

Figure 1:
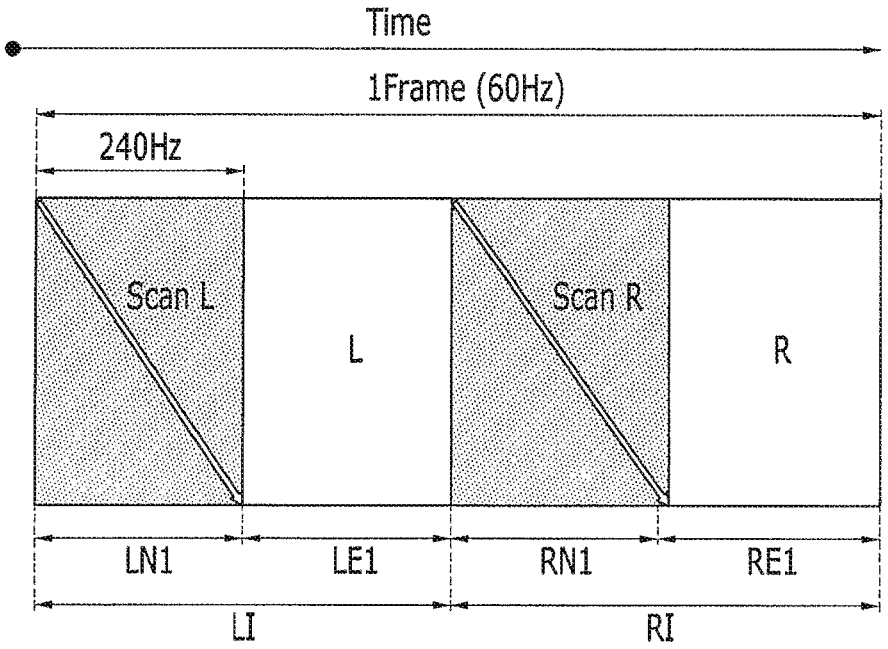
FIG. 1 is a diagram for describing a method of driving an organic light emitting diode display in a conventional active matrix type display.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

Hereinafter, exemplary embodiments through which the present invention can be easily implemented by those skilled in the art will be described in detail with reference to the accompanying drawings.

Figure 2:
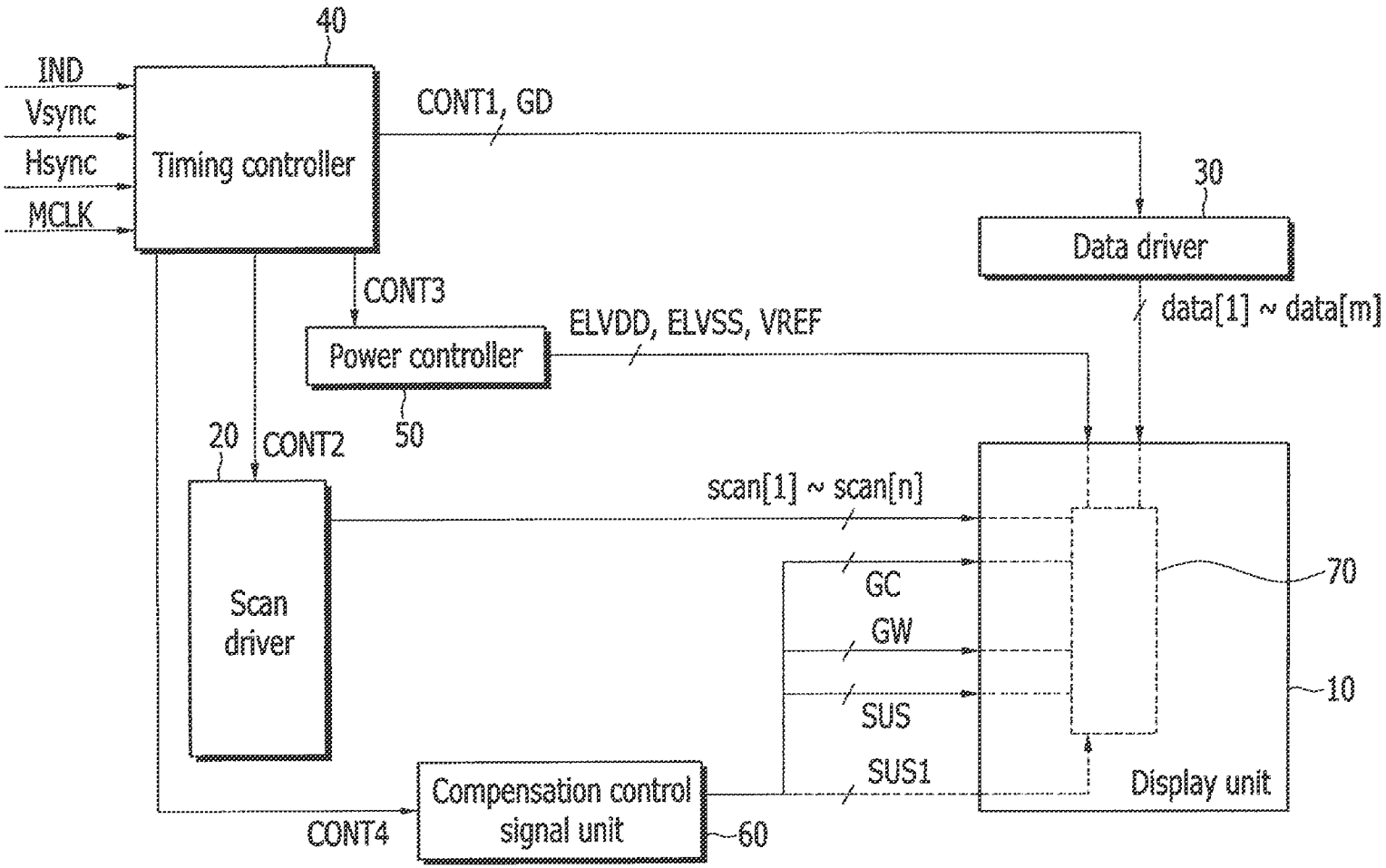
FIG. 2 is a block diagram illustrating an organic light emitting diode display according to an exemplary embodiment of the present invention.

FIG. 2 is a block diagram illustrating an organic light emitting diode display according to an exemplary embodiment of the present invention.

Referring to FIG. 2, an organic light emitting diode display 100 according to an exemplary embodiment of the present invention includes a display unit 10, a scan driver 20, a data driver 30, a timing controller 40, a power controller 50, and a compensation control signal unit 60.

The display unit 10 includes a plurality of pixels 70 which emit light to display an image according to an image data signal GD which corresponds to an external image signal IND. The pixels 70 are connected to corresponding data lines among a plurality of data lines which transmit a plurality of data signals data[1] to data[m] and corresponding scan lines among a plurality of scan lines which transmit a plurality of scan signals scan[1] to scan[n].

The plurality of data signals data[1] to data[m] correspond to signals generated through an image processing procedure such as a luminance correction process for the external image signal IND. Further, the plurality of scan signals scan[1] to scan[n] correspond to signals for transmitting a data signal corresponding to each of the plurality of pixels 70.

Moreover, the pixels 70 are connected to a plurality of power lines which transmit first and second power voltages ELVDD and ELVSS and a reference voltage VREF. Furthermore, the pixels 70 are connected to each of a corresponding first control signal line among a plurality of first control signal lines which transmit a plurality of first control signals GC, a corresponding second control signal line among a plurality of second control signal lines which transmit a plurality second control signals GW, and a corresponding third control signal line among a plurality of third control signal lines which transmit a plurality of third control signals SUS.

According to another embodiment, the pixels 70 are connected to each corresponding fourth control signal line among a plurality of fourth control signal lines which transmit a plurality of fourth control signals SUS1.

The scan driver 20 is connected to a plurality of scan lines and generates the plurality of scan signals scan[1] to scan[n] according to a scan control signal CONT2. The scan driver 20 sequentially transmits the plurality of scan signals scan [1] to scan[n] to the plurality of scan lines.

Further, the data driver 30 is connected to a plurality of data lines and generates the plurality of data signals data[1] to data[m] by sampling and holding the image data signal GD according to a data control signal CONT1. The data driver 30 transmits the plurality of data signals data[1] to data[m] to the plurality of data lines, respectively.

The power controller 50 is connected to a plurality of power lines and transmits the first power voltage ELVDD, the second power voltage ELVSS, and the reference voltage VREF to the plurality of power lines according to a power control signal CONT3. The power controller 50 can control voltage levels of the first power voltage ELVDD, the second power voltage ELVSS, and the reference voltage VREF according to the power control signal CONT3.

The compensation control signal unit 60 is connected to a plurality of first to third control signal lines and generates a plurality of first control signals GC, a plurality of second control signals GW, and a plurality of third control signals SUS according to a compensation control signal CONT4.

According to one embodiment of the present invention, the compensation control signal unit 60 is connected to a plurality of fourth control signal lines and further generates a plurality of fourth control signals SUS1 according to the compensation control signal CONT4.

The timing controller 40 receives the external image signal IND and a synchronization signal and converts the image signal IND to an image data signal GD, and controls a function and driving of each component of the display device. Here, the synchronization signal includes a vertical synchronization signal Vsync, a horizontal synchronization signal Hsync, and a main clock signal MCLK. Specifically, the timing controller 40 divides the image signal IND in the unit of frames (e.g., into a plurality of unit frames) according to the vertical synchronization signal Vsync and divides the image signal IND (e.g., each frame) in the unit of scan lines according to the horizontal synchronization signal Hsync so as to generate the image data signal GD.

Figure 3:
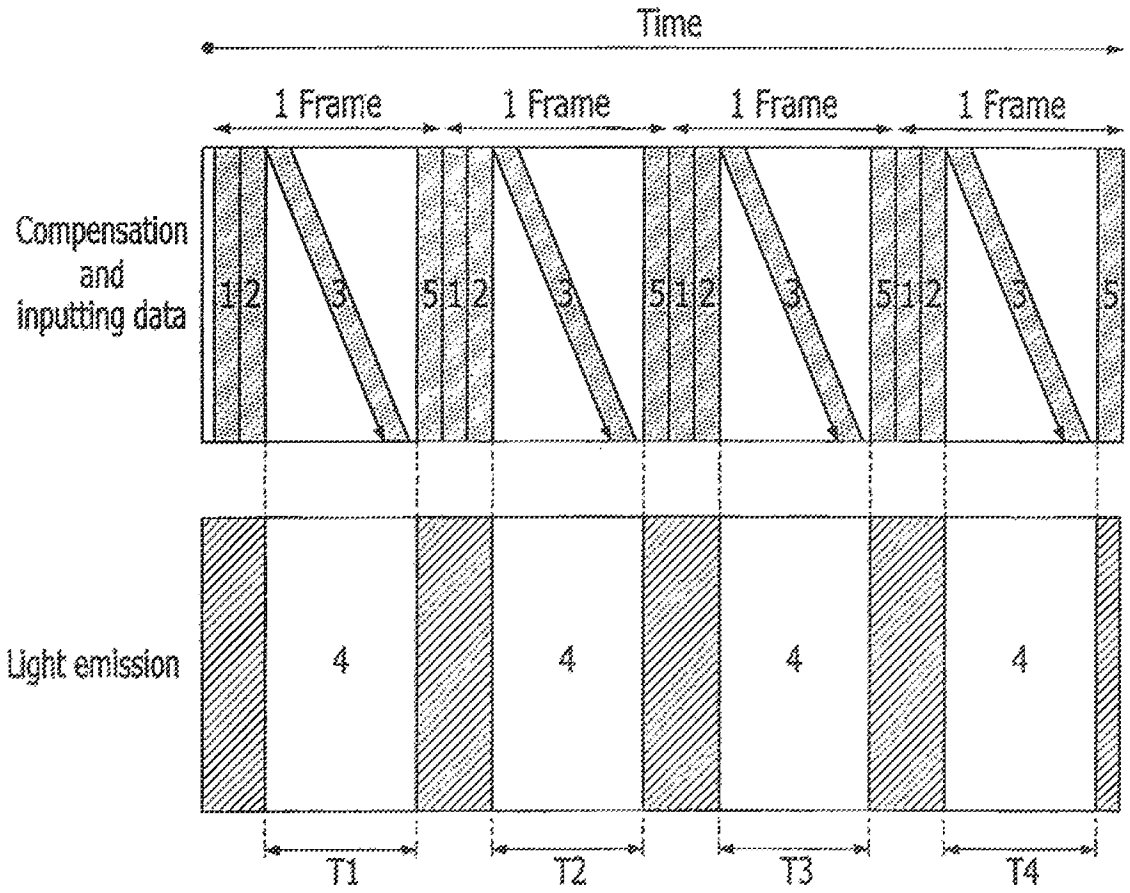
FIG. 3 is a diagram for describing a method of driving an organic light emitting diode display according to an exemplary embodiment of the present invention.

FIG. 3 is a diagram for describing a method of driving an organic light emitting diode display according to an exemplary embodiment of the present invention.

Referring to FIG. 3, one frame period for which one image is displayed on the display unit 10 includes an initialization period 1 in which driving voltages of the plurality of pixels 70 are reset and initialized, a compensation period 2 in which threshold voltages of driving transistors of the plurality of pixels 70 compensated for, a scan period 3 in which the data signal is input to each of the plurality of pixels 70, a light emitting period 4 in which light is emitted according to the data signals input into the plurality of pixels 70, and a bias period 5 in which bias voltages are applied to the driving transistors of the plurality of pixels 70.

The scan period 3 and the light emitting period 4 are overlappingly generated in time (or overlap in time). The plurality of pixels 70 emit light during the light emitting period 4 of a current frame according to data input during the scan period 3 of a previous frame and emit light for the light emitting period 4 of a next frame according to data input into the plurality of pixels 70 for the scan period 3 of the current frame.

A period T1 includes the scan period 3 and the light emitting period 4 of an $N^{th}$ frame. Accordingly, data input into the plurality of pixels 70 for the scan period 3 of the period T1 corresponds to data of the $N^{th}$ frame, and the plurality of pixels 70 emit light for the light emitting period 4 of the period T1 according to data of an $N-1^{th}$ frame input during the scan period 3 of the $N-1^{th}$ frame.

A period T2 includes the scan period 3 and the light emitting period 4 of an $N+1^{th}$ frame. Accordingly, data input into the plurality of pixels 70 during the scan period 3 of the period T2 corresponds to data of the $N+1^{th}$ frame, and the plurality of pixels 70 emit light for the light emitting period 4 of the period T2 according to data of the $N^{th}$ frame input for the scan period 3 (for example, the period T1) of the $N^{th}$ frame.

Data of an $N+2^{th}$ frame and data of an $N+3^{th}$ frame are input into the plurality of pixels 70 for the scan periods 3 of the periods T3 and T4, respectively, and the plurality of pixels 70 emit light for the light emitting periods 4 of the periods T3 and 14 according to data input for the scan period 3 of the $N+1^{th}$ frame and data input for the scan period 3 of the $N+2^{th}$ frame.

Hereinafter, a pixel structure (or circuit) will be described in which data of the current frame is input into the plurality of pixels 70 for the scan period 3 and the plurality of pixels 70 emit light for the light emitting period 4 which is the same period as the scan period 3 according to data of the previous frame.

Figure 4:
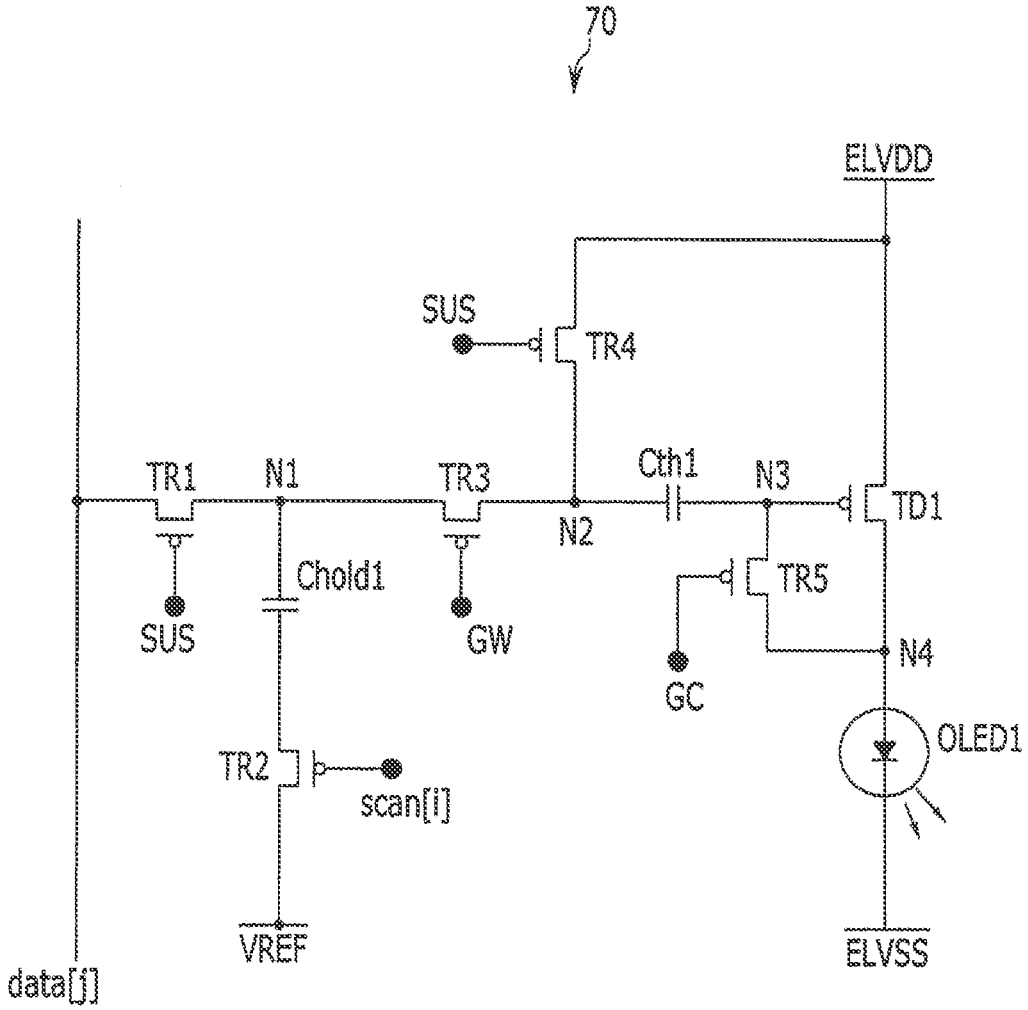
FIG. 4 is a diagram illustrating a pixel circuit according to an exemplary embodiment of the present invention.

FIG. 4 is a diagram illustrating a pixel circuit according to an exemplary embodiment of the present invention.

Referring to FIG. 4, the pixel 70 includes an organic light emitting diode OLED1 which emits light according to (or in accordance with) the corresponding data signals data[1] to data[m] and a driving circuit. The driving circuit includes five transistors including first, second, third, fourth, and fifth transistors TR1, TR2, TR3, TR4, and TR5, and two capacitors including a sustain capacitor Chold1 and a compensation capacitor Cth1. For example, a pixel 70 connected to an $i^{th}$ scan line and a $j^{th}$ data line is described herein as an example of the pixels 70 illustrated in FIG. 3.

The first transistor TR1 includes a first electrode to which the data signal data[j] is applied, a gate electrode to which the third control signal SUS is applied, and a second electrode connected to a first node N1. The first transistor TR1 is turned on according to the third control signal SUS to connect the data line through which the data signal data[j] is transmitted to the first node N1. Here, when a voltage (hereinafter, referred to as a data voltage Vdata) corresponding to the data signal data[j] is stored in the compensation capacitor Cth1, the first transistor TR1 blocks or electrically disconnects the connection between the data line and the first node N1.

The sustain capacitor Chold1 includes the first electrode connected to the first node N1 and the second electrode connected to the first electrode of a second transistor TR2. While the organic light emitting diode OLED1 emits light with a driving current according to the data signal data[j] of the previous frame, the sustain capacitor Chold1 stores the data voltage Vdata according to the data signal data[j] to be displayed in the current frame.

The second transistor TR2 includes a first electrode connected to the second electrode of the sustain capacitor Chold1, the second electrode to which the reference voltage VREF is applied, and a second electrode to which the scan signal scan[i] is applied. The second transistor TR2 is turned on according to the scan signal scan[i] to transmit the reference voltage VREF to the second electrode of the sustain capacitor Chold1.

The third transistor TR3 includes the first electrode connected to the first node N1, a second electrode connected to a second node N2, and a gate electrode to which the second control signal GW is applied. The third transistor TR3 is turned on according to the second control signal GW to connect the first node N1 and the second node N2. The third transistor TR3 transmits the data voltage Vdata stored in the sustain capacitor Chold1 to the compensation capacitor Cth1.

The fourth transistor TR4 includes a first electrode to which the first power voltage ELVDD is applied, the second electrode connected to the second node N2, and a gate electrode to which the third control signal SUS is applied. The fourth transistor TR4 is turned on according to the third control signal SUS to transmit the first power voltage ELVDD to the second node N2.

The compensation capacitor Cth1 includes a first electrode connected to the second node N2 and a second electrode connected to a third node N3. The compensation capacitor Cth1 sustains a voltage value applied to the third node N3 during the compensation period 2, for example, a voltage value which reflects a threshold voltage Vth of a driving transistor TD1 for the data voltage Vdata.

The fifth transistor TR5 includes a first electrode connected to the third node N3, a second electrode connected to a fourth node N4, and a gate electrode to which the first control signal GC is applied. The fifth transistor TR5 is turned on according to the first control signal GC to diode-connect a drain electrode and the gate electrode of the driving transistor TD1.

The driving transistor TD1 includes a source electrode to which the first power voltage ELVDD is applied, a drain electrode connected to the fourth node N4, and a gate electrode connected to the third node N3. The driving transistor TD1 controls a driving current flowing in the organic light emitting diode OLED1 according to (or in accordance with) a voltage value of the third node N3.

The organic light emitting diode OLED1 includes an anode connected to the fourth node N4 and a cathode to which the second power voltage ELVES is applied. The organic light emitting diode OLED1 can emit one light of primary colors. Examples of the primary colors include three primary colors such as red, green and blue, and a desired color (e.g., emitted by a display device) may be expressed by a spatial combination or a temporal combination of the three primary colors.

The first, second, third, fourth and fifth transistors TR1, TR2, TR3, TR4, and TR5 and the driving transistor TD1 may be p-channel field effect transistors. In such an embodiment, a gate on (or transistor turn-on) voltage which turns on the first, second, third, fourth, and fifth transistors TR1, TR2, TR3, TR4, and TR5 is a low level voltage and a gate off voltage (or transistor turn-off voltage) which turns off the first, second, third, fourth, and fifth transistors TR1, TR2, TR3, TR4, and TR5 is a high level voltage.

Here, although the transistors correspond to the p-channel field effect transistors, at least one of the first, second, third, fourth, and fifth transistors TR1, TR2, TR3, TR4, and TR5 and the driving transistor TD1 may be an n-channel field effect transistor.

Figure 5:
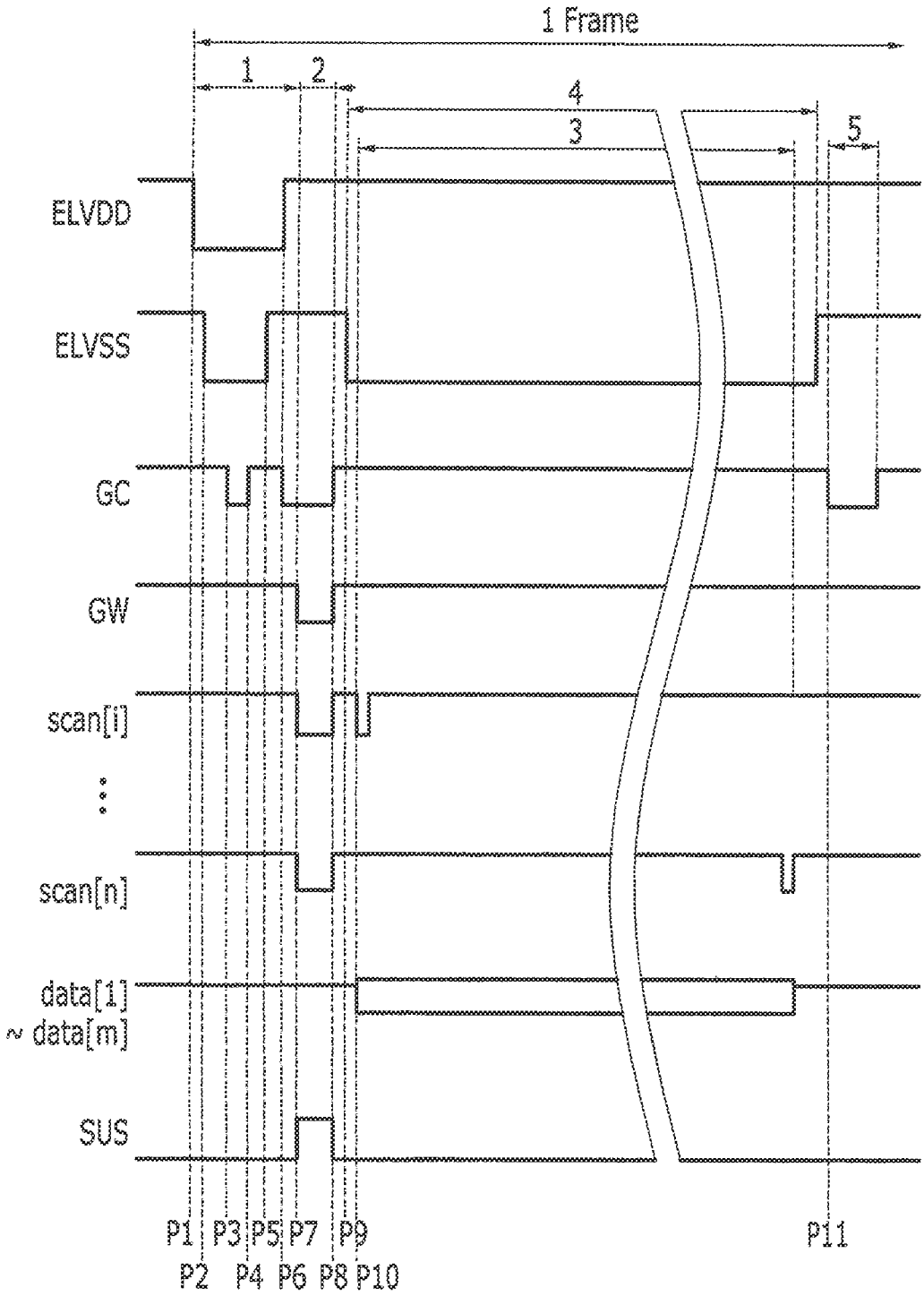

FIG. 5 is a timing diagram illustrating a method of driving an organic light emitting diode display according to an exemplary embodiment of the present invention.

During one frame, the first power voltage ELVDD, the second power voltage ELVSS, the scan signals scan[1] to scan[n], the first control signal GC, the second control signal GW, the third control signal SUS, and the data signals data[1] to data[m] are changed (or vary) according to (or during) each of the initialization period 1, the compensation period 2, the scan period 3, the light emitting period 4, and the bias period 5.

During the initialization period 1, the first power voltage ELVDD is changed from a high level to a low level at a time P1. At this time, the third control signal SUS is at the low level (or low voltage level). The fourth transistor TR4 is in a turn-on (or turned-on) state, and a voltage of the second node N2 is changed to the low level of the first power voltage ELVDD.

At this time, a voltage of the third node N3 is also lowered due to coupling by the compensation capacitor Cth1. The voltage of the third node N3 becomes a low voltage low enough to turn on the driving transistor TD1. A current flows from the fourth node N4 to a signal line of the first power voltage ELVDD through the driving transistor TD1, so that a voltage of the fourth node N4 is lowered.

Next, when the second power voltage ELVSS is changed from the high level to the low level at a time P2, the voltage of the fourth node N4 is further lowered due to coupling by a parasitic capacitance of the organic light emitting diode OLED1.

Next, the first control signal GC is applied with the low level and the fifth transistor TR5 is turned on at a time P3. Then, the third node N3 and the fourth node N4 are connected, and the voltage of the third node N3 and the fourth node N4 becomes a voltage in a similar level to the low level of the first power voltage ELVDD. For example, voltages of the gate electrode and the drain electrode of the driving transistor TD1 are reset to the low level.

Next, the first control signal GC is applied with the high level (or at a high voltage level) and the fifth transistor TR5 is turned off at a time P4. Next, the second power voltage ELVSS is changed from the low level to the high level at a time P5. Then, the voltage of the fourth node N4 is increased by a parasitic capacitor connected to the organic light emitting diode OLED1 in parallel (e.g., the parasitic capacitance of the organic light emitting diode OLED1, which is analyzed as being in parallel with the organic light emitting diode OLED1).

At this time, because the fifth transistor TR5 is in a turn off (or turned off) state and the voltage of the third node N3 maintains the low level, the driving transistor TD1 is turned on by a difference of a gate-source voltage. A current flows from the fourth node N4 to a signal line of the first power voltage ELVDD through the driving transistor TD1, and the voltage of the fourth node N4 is lowered again.

During the compensation period 2, the first power voltage ELVDD is changed from the low level to the high level and the first control signal GC is applied with the low level at a time P6. Then, the fifth transistor TR5 is turned on to diode-connect the driving transistor TD1. The voltage of the third node N3 becomes ELVDD+Vth. Here, ELVDD refers to a high level voltage of the first power voltage ELVDD and Vth refers to a threshold voltage of the driving transistor TD1.

At this time, because the fourth transistor TR4 maintains a turn on state, the voltage of the second node N2 is changed to the high level of the first power voltage ELVDD.

Next, the third control signal SUS is applied with the high level to turn off the fourth transistor TR4 at a time P7. Further, the second control signal GW is applied with the low level to turn on the third transistor TR3. Then, the first node N1 and the second node N2 are connected.

Concurrently (e.g., simultaneously), the scan signal scan[i] is applied with the low level to turn on the second transistor TR2. Then, the second electrode of the sustain capacitor Chold1 is connected to a signal line of the reference voltage VREF. Accordingly, the data voltage Vdata stored in the sustain capacitor Chold1 is transmitted to the compensation capacitor Cth1. Here, the data voltage Vdata stored in the sustain capacitor Chold1 corresponds to a voltage stored during the scan period 3 of the previous frame.

When the sustain capacitor Chold1 and the compensation capacitor Cth1 are connected, a voltage Vn2 of the second node N2 is changed to a voltage which reflects a voltage change amount of the second node N2 to a previous voltage of the second node N2 by the parasitic capacitance of the organic light emitting diode OLED1 and the parasitic capacitance of the driving transistor TD1 which are connected in series. For example, the voltage Vn2 is changed as shown in [Equation 1].

$$Vn2 = \text{previous voltage of second node } N2 + \text{voltage change amount of second node } N2 * \alpha = ELVDD + (Vdata - ELVDD) * \alpha \quad \text{Equation 1}$$

(where $\alpha = Ch/(Ch+Cx)$, $Cx = Ct*(Cpara+Coled)/(Ct+Cpara+Coled)$)

Here, ELVDD denotes a high level of the first power voltage ELVDD, Ch denotes the capacitance of the sustain capacitor Chold1, Cpara denotes the capacitance of the parasitic capacitance of the driving transistor TD1, Coled denotes the capacitance of the parasitic capacitance of the organic light emitting diode OLED1, and Ct denotes the capacitance of the compensation capacitor Cth1.

Next, the second control signal GW is applied with the high level to turn off the third transistor TR3 at a time P8. For example, the first node N1 and the second node N2 are separated or electrically disconnected.

Further, the third control signal SUS is applied with the low level and the first and fourth transistors TR1 and TR4 are turned on at a time P8.

At this time, because the scan signal scan[i] is applied with the high level to turn off the second transistor TR2, the second electrode of the sustain capacitor Chold1 remains in a floating state.

Further, the voltage of the second node N2 is changed to the high level of the first power voltage ELVDD. At this time, a voltage of (ELVDD+Vth)−Vn2 is stored in the compensation capacitor Cth1. Accordingly, as the voltage of the second node N2 is changed, a voltage Vn3 of the third node N3 is changed as defined in [Equation 2] below by coupling of the compensation capacitor Cth1.

$$\begin{aligned} Vn3 &= \text{voltage change amount of second node } N2 * \beta \\ &= (ELVDD + Vth) + \beta^*(ELVDD - Vn2) \\ &= (1+\beta)^* ELVDD + Vth - \beta^* Vn2 \\ &= (1+\beta)^* ELVDD + Vth - \beta\{ELVDD + (Vdata - ELVDD)^*\alpha\} \\ &= ELVDD + Vth - \alpha^*\beta(Vdata - ELVDD) \end{aligned} \quad \text{Equation 2}$$

(where $\beta = Ct/(Ct + Cpara)$)

During the light emitting period 4, the second power voltage ELVSS is changed from the high level to the low level at a time P9. Then, a current flows to the organic light emitting diode OLED1 through the driving transistor TD1. A driving current I_OLED flowing to the organic light emitting diode OLED1 is defined as shown in [Equation 3] below.

$$\begin{aligned} I_OLED &= k^*(Vgs - Vth)\hat{}2 \\ &= k^*(ELVDD + Vth - \alpha^*\beta^*(Vdata - ELVDD) - \\ &\quad ELVDD - Vth)\hat{}2 \\ &= k^*\{\alpha^*\beta^*(Vdata - ELVDD)\}\hat{}2 \end{aligned} \quad \text{Equation 3}$$

Here, k denotes a parameter determined according to a characteristic of the driving transistor TD1, and Vgs denotes a gate-source voltage of the driving transistor TD1.

The organic light emitting diode OLED1 emits light in brightness corresponding to the driving current I_OLED. As defined in [Equation 3], the driving current I_OLED is controlled regardless of the threshold voltage Vth of the driving transistor TD1, so that the organic light emitting diode OLED1 emits light in brightness corresponding to the data voltage Vdata. When the light emitting period 4 ends, the second power voltage ELVSS is changed to the high level.

Meanwhile, in the scan period 3, the plurality of scan signals scan[1] to scan[n] are sequentially applied to the corresponding scan lines with the low level at a time P10. Then, the second transistor TR2 is turned on. At this time, the first transistor TR1 is in a turn on state.

The plurality of data signals data[1] to data[m] are transmitted to the first node N1 through the corresponding data lines. Then, the corresponding data voltage Vdata is stored in the sustain capacitor Chold1.

When the second transistor TR2 is turned of after the data voltage is stored in the sustain capacitor Chold1, the second electrode of the sustain capacitor Chold1 has a floating state. Accordingly, even though the data voltage Vdata is changed, the voltage stored in the sustain capacitor Chold1 is maintained. The voltage stored in the sustain capacitor Chold1 is used during the light emitting period 4 of a next frame.

During the bias period 5, the second power voltage ELVSS is changed to the high level at a time P11. Further, the first control signal GC is applied at the low level. Then, the fifth transistor TR5 is turned on and the third node N3 and the fourth node N4 are connected.

At this time, because the fourth transistor TR4 is in a turn on state, the voltage of the second node N2 becomes the high level of the first power voltage ELVDD. For example, the gate electrode and the drain electrode of the driving transistor TD1 are reset by the high level voltage of the first power voltage ELVDD. The bias period 5 is to improve an optical response waveform of the pixels 70 and thus can be omitted (e.g., is optional).

In addition, in one exemplary embodiment of the present invention (although embodiments of the present invention are not limited thereto), the first control signal GC and the second control signal GW are connected to one signal line (e.g., the same signal line) to secure a layout area. In this embodiment, an operation of diode-connecting the gate electrode and the drain electrode of the driving transistor TD1 by the first control signal GC during the initialization period 1 may be omitted.

Figure 6:
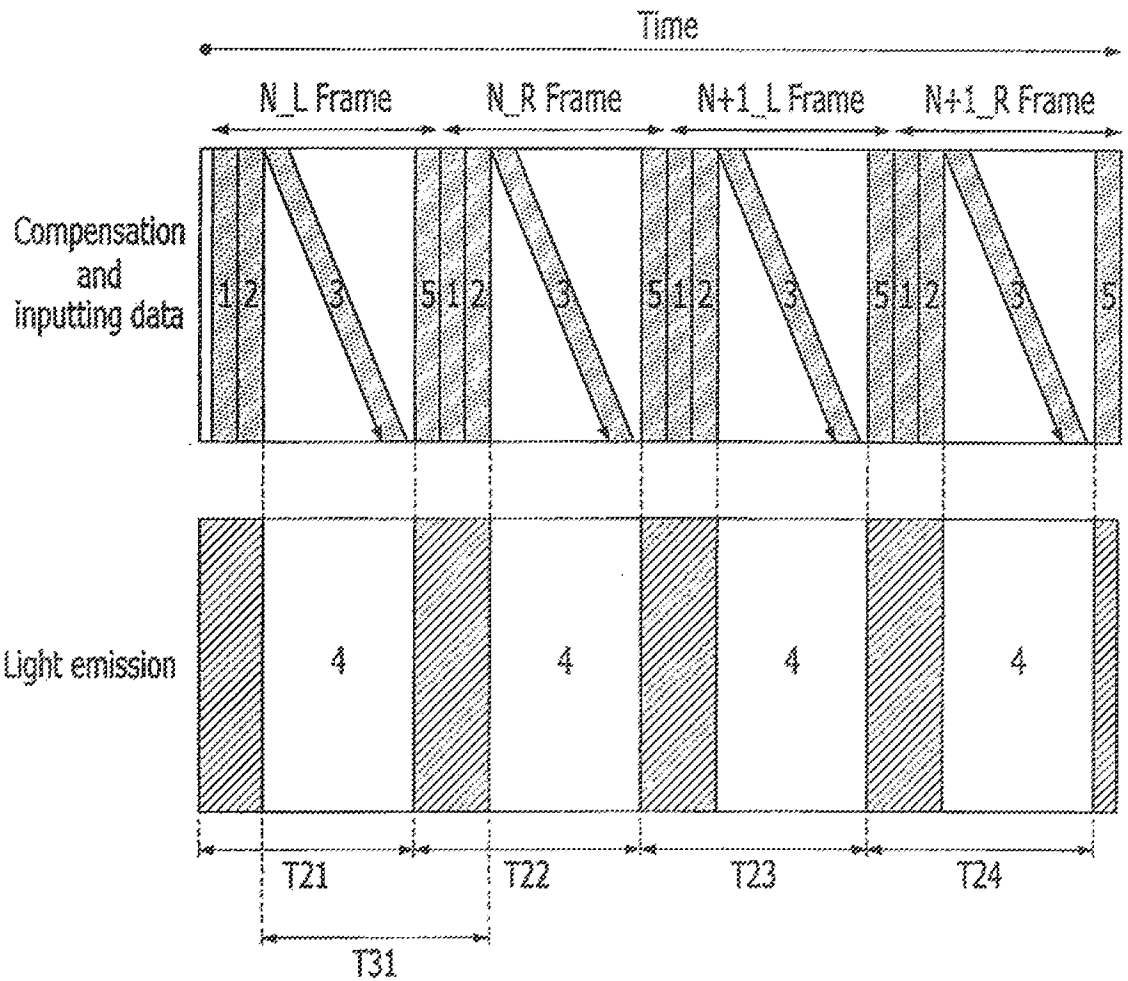
FIG. 6 is a diagram illustrating a method of driving an organic light emitting diode display according to another exemplary embodiment of the present invention.

FIG. 6 is a diagram illustrating a method of driving an organic light emitting diode display according to another exemplary embodiment of the present invention.

Referring to FIG. 6, in the driving method, an organic light emitting diode display 10 alternately displays a left-eye image and a right-eye image according to a shutter spectacles method. As illustrated in FIG. 6, each frame includes the initialization period 1, the compensation period 2, the scan period 3, the light emitting period 4, and the bias period 5.

A frame in which a plurality of data signals (hereinafter, referred to as left-eye image data signals) indicating the left-eye image are input into the plurality of pixels 70 is indicated by a reference numeral "L", and a frame in which a plurality of data signals (hereinafter, referred to as right-eye image data signals) indicating the right-eye image are input into the plurality of pixels 70 is indicated by a reference numeral "R".

Because waveforms of the first power voltage ELVDD, the second power voltage ELVSS, the first control signal GC, the second control signal GW, the third control signal SUS, the scan signals scan[1] to scan[n], and the data signals data[1] to data[m] are substantially the same as the waveforms illustrated in FIG. 5 in each of the initialization period 1, the compensation period 2, the scan period 3, the light emitting period 4, and the bias period 5, a detailed description of each period will be omitted below.

During the scan period 3 of a period T21, left-eye image data signals of an N_L frame are input into the plurality of pixels 70. For the scan period 3, the left-eye image data signal corresponding to each of the plurality of pixels 70 is input. At this time, during the light emitting period 4 of the period T21, the plurality of pixels 70 emit light according to right-eye image data signals input in the scan period 3 of an N−1_R frame.

During the scan period 3 of a period T22, right-eye image data signals of an N_R frame are input into the plurality of pixels 70. During the scan period 3, the right-eye image data signal corresponding to each of the plurality of pixels 70 is input. At this time, during the light emitting period 4 of the period T22, the plurality of pixels 70 emit light according to the left-eye image data signals input in the scan period 3 of the N_L frame.

During the scan period 3 of a period 123, left-eye image data signals of an N+1_L frame are input into the plurality of pixels 70. During the scan period 3, the left-eye image data signal corresponding to each of the plurality of pixels 70 is input. At this time, during the light emitting period 4 of the T23, the plurality of pixels 70 emit light according to the right-eye image data signals input in the scan period 3 of the N_R frame.

During the scan period 3 of a period T24, right-eye image data signals of an N+1_R frame are input into the plurality of pixels 70. During the scan period 3, the right-eye image data signal corresponding to each of the plurality of pixels 70 is input. At this time, during the light emitting period 4 of the period T24, the plurality of pixels 70 emit light according to the left-eye image data signals input in the scan period 3 of the N+1_L frame.

In substantially the same way, the right-eye image is concurrently (e.g., simultaneously) emitted while the left-eye image is input (or written to the pixels), and the left-eye image is concurrently (e.g., simultaneously) emitted while the right-eye image is input (or written to the pixels). Then, the light emitting period is sufficiently secured, and thus a picture quality of the stereoscopic image is improved.

Because the scan period 3 and the light emitting period 4 are included in the same period, an interval T31 between the light emitting period 4 of respective frames may be set regardless of the scan period. At this time, the interval T31 between the light emitting periods 4 may be set as an interval optimized for a liquid crystal response speed of the shutter spectacles.

In the conventional display in which the scan period 3 and the light emitting period 4 are not included in the same period (e.g., do not take place concurrently), the light emitting period 4 is located after the scan period 3, so that a temporal margin which can set the light emitting period 4 during one frame period is low. In a proposed driving method according to one embodiment of the present invention, the light emitting period 4 may take place during all periods other than the initialization period 1, the compensation period 2, and the bias period 5 for one frame period. Accordingly, the temporal margin which can set the light emitting period 4 is increased in comparison with a conventional display, so that the interval T31 between the light emitting periods 4 may be set in consideration of, for example, the liquid crystal response speed of the shutter spectacles.

For example, the interval T31 between the light emitting periods 4 may be set in consideration of time taken to completely open a right-eye lens (or left-eye lens) of the shutter spectacles from a time point when emission of the left-eye image (or right-eye image) ends.

Figure 7:
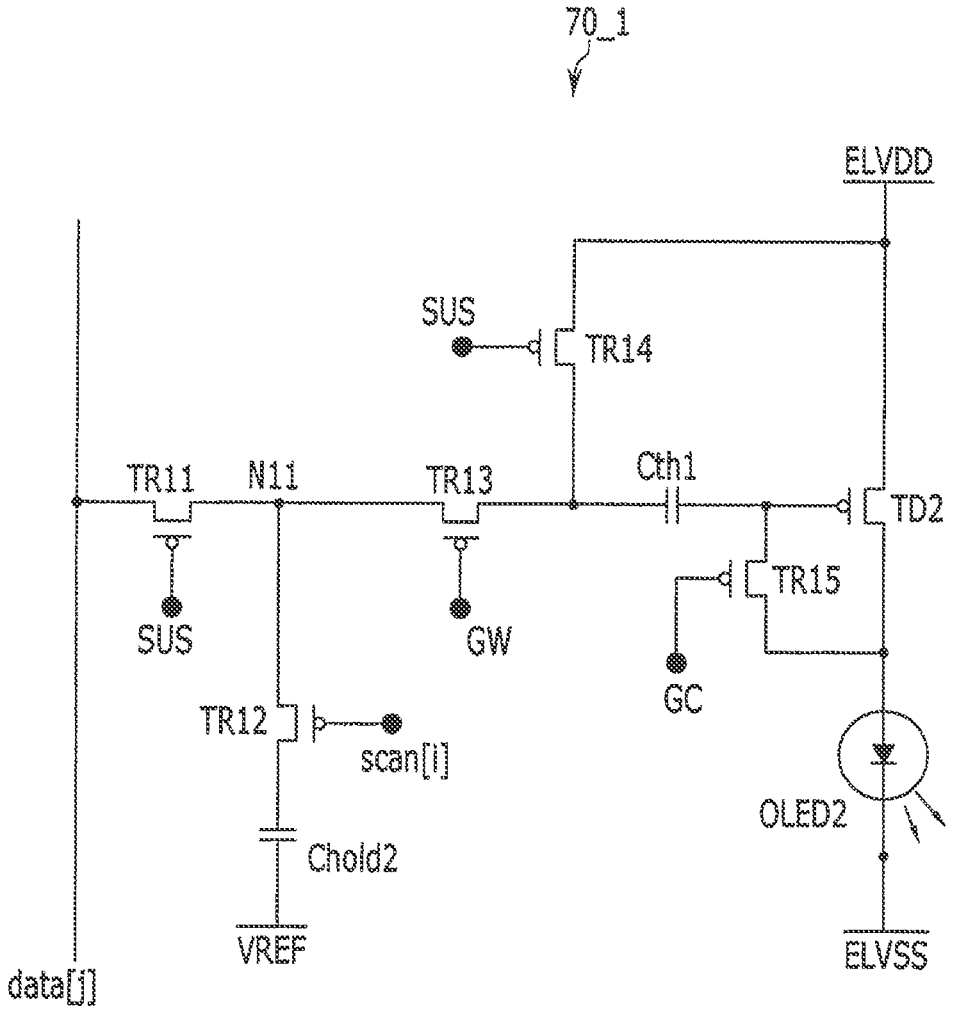
FIG. 7 is a diagram illustrating a pixel circuit according to another exemplary embodiment of the present invention.

FIG. 7 is a diagram illustrating a pixel circuit according to another exemplary embodiment of the present invention.

Referring to FIG. 7, a pixel 70_1 includes first, second, third, fourth, and fifth transistors TR11, TR12, TR13, TR14, and TR15, a driving transistor TD2, a sustain capacitor Chold2, a compensation capacitor Cth2 and an organic light emitting diode OLED2.

The pixel 70_1 illustrated in FIG. 7 differs from FIG. 4 in that positions of the second transistor TR12 and the sustain capacitor Chold2 are exchanged. For example, the second transistor TR12 includes a first electrode connected to a first node N11, a second electrode connected to a first electrode of the sustain capacitor Chold2, and a gate electrode to which the scan signal scan[i] is applied. The sustain capacitor Chold2 includes a second electrode to which the reference voltage VREF is applied.

Although a method of driving the pixel 70_1 is substantially the same as the method described in FIG. 5, the second transistor TR12 may be located close to the first and third transistors TR11 and TR13 on a layout.

Figure 8:
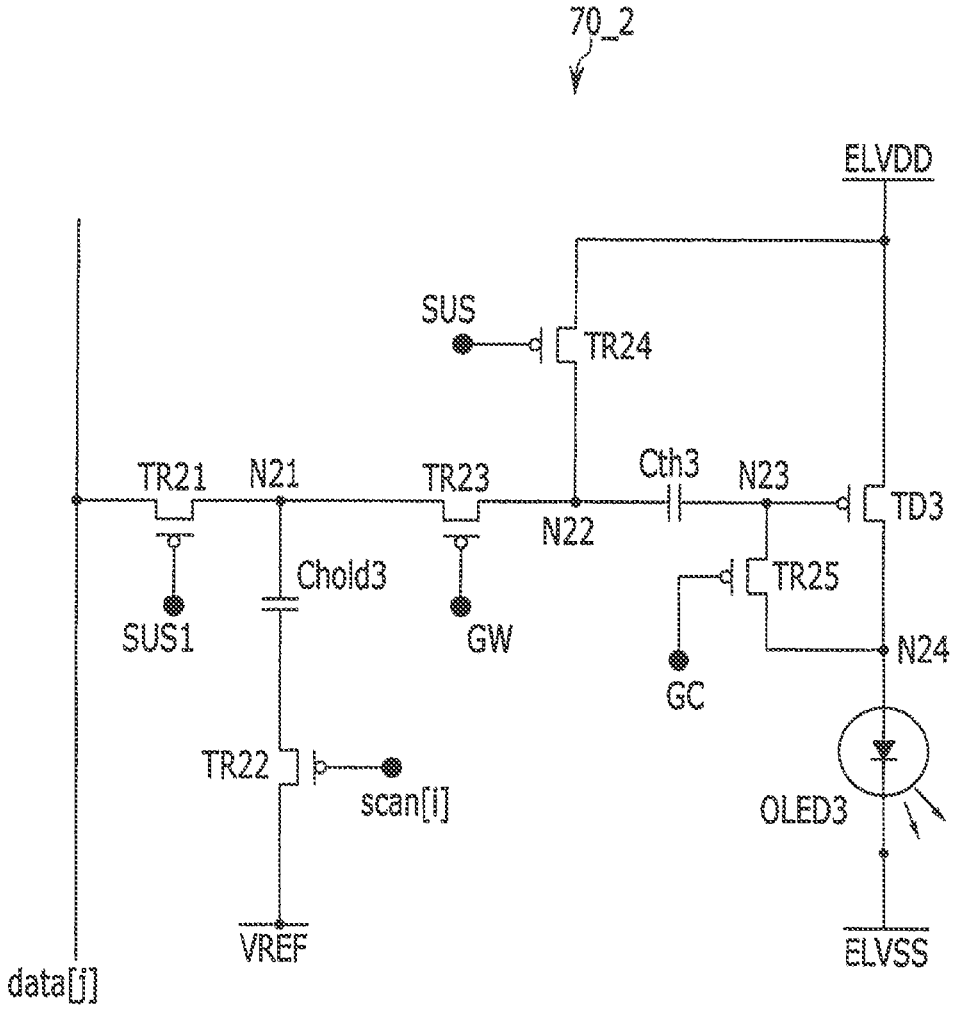
FIG. 8 is a diagram illustrating a pixel circuit according to another exemplary embodiment of the present invention.

FIG. 8 is a diagram illustrating a pixel circuit according to another exemplary embodiment of the present invention.

Referring to FIG. 8, a pixel 70_2 includes first, second, third, fourth, and fifth transistors TR21, TR22, TR23, TR24, and TR25, a driving transistor TD3, a sustain capacitor Chold3, a compensation capacitor Cth3 and an organic light emitting diode OLED3.

The pixel 70_2 illustrated in FIG. 8 differs from FIG. 4 in that the fourth control signal SUS1 is applied to a gate electrode of the first transistor TR21. For example, the first transistor TR21 is turned on according to the fourth control signal SUS1 to connect a data line through which the data signal data[j] is transmitted and a first node N21. The first transistor TR21 blocks connection between or electrically disconnects the data line and the first node N21 during the initialization period 1 as well as the compensation period 2. For example, when a second electrode of the sustain capacitor Chold3 remains in a floating state by the scan signal scan[i], a first electrode of the sustain capacitor Chold3 is separated from the data one. Accordingly, it is possible to prevent or reduce loss of the data voltage Vdata stored in the sustain capacitor Chold3 data due to a current leaking into the data line.

The method of driving the pixel 70_2 will be described with reference to FIG. 9 below.

Figure 9:
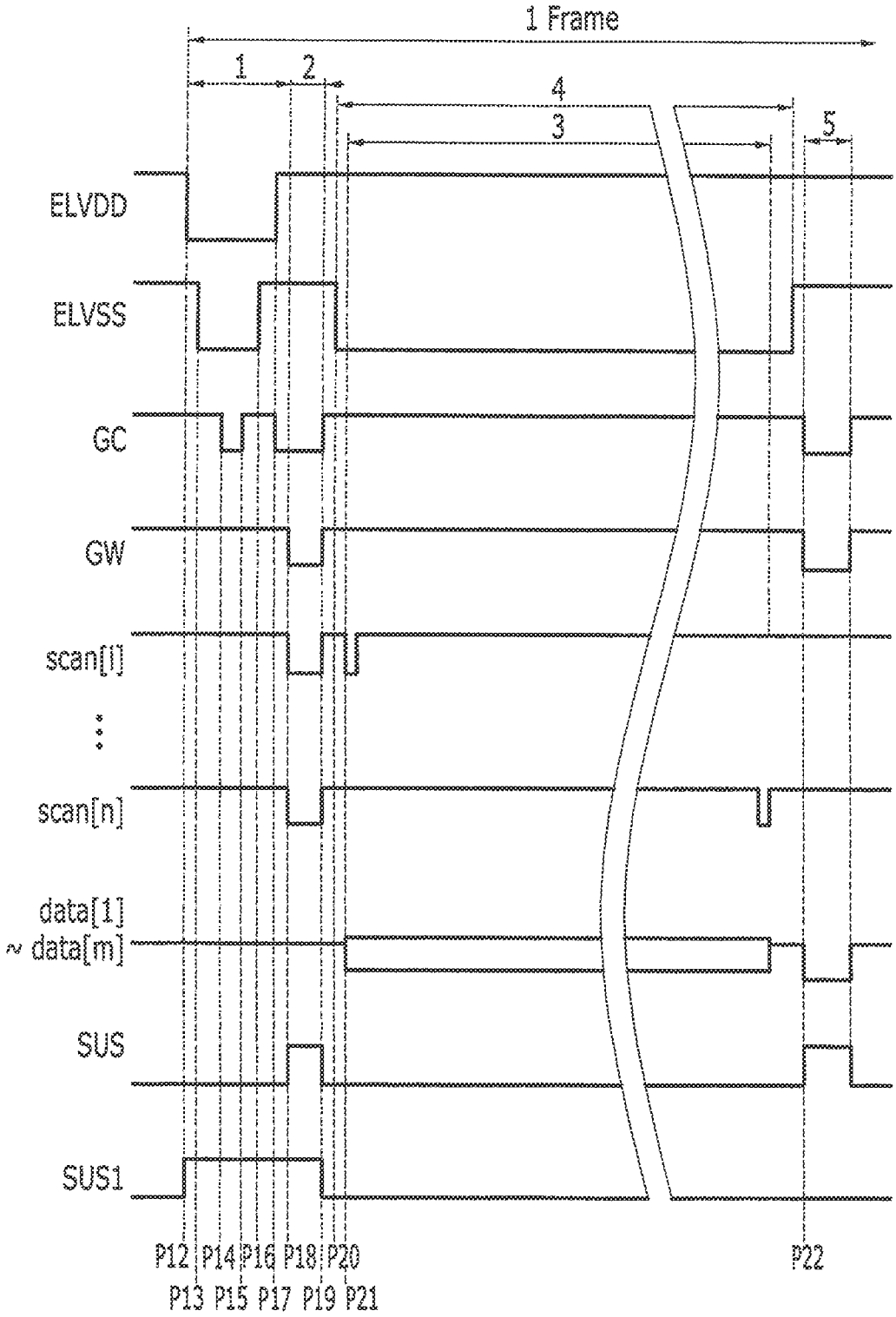
FIG. 9 is a timing diagram illustrating a method of driving an organic light emitting diode display according to another exemplary embodiment of the present invention.

FIG. 9 is a timing diagram illustrating a method of driving an organic light emitting diode display according to another exemplary embodiment of the present invention.

Referring to FIG. 9, in the initialization period 1, the first power voltage ELVDD is changed from the high level to the low level at a time P12. At this time, the third control signal SUS remains in the low level, and the fourth control signal SUS1 is applied with the high level. The first transistor TR21 is turned off, and the fourth transistor TR24 is turned on.

Then, the data line and the first electrode of the sustain capacitor Chold3 are separated, and a voltage of a second node N22 is changed to the low level of the first power voltage ELVDD. At this time, a voltage of a third node N23 is also lowered due to coupling by the compensation capacitor Cth3. The voltage of the third node N23 becomes a low voltage enough (or sufficiently low voltage) to turn on the driving transistor TD3. A current flows from a fourth node N24 to a signal line of the first power voltage ELVDD through the driving transistor TD3, and thus a voltage of the fourth node N24 is lowered.

Next, at a time P13, when the second power voltage ELVSS is changed from the high level to the low level, the voltage of the fourth node N24 is further lowered due to coupling by a parasitic capacitance of an organic light emitting diode OLED3.

Next, at a time P14, the first control signal GC is applied with the low level and a fifth transistor TR25 is turned on. Then, the third node N23 and the fourth node N24 are connected, voltages of the third node 123 and the fourth node 124 become voltages having a similar level as the low level of the first power voltage ELVDD.

Next, at a time P15, the first control signal GC is applied with the high level and the fifth transistor TR25 is turned off. Next, at a time P16, the second power voltage ELVSS is changed from the low level to the high level. Then, the voltage of the fourth node N24 increases by the parasitic capacitance of the organic light emitting diode OLED3.

At this time, because the fifth transistor TR25 is in a turn off state and the voltage of the third node N23 remains in the low level, the driving transistor TD3 is turned on by a difference of a gate-source voltage. A current flows from the fourth node N24 to a signal line of the first power voltage ELVDD through the driving transistor TD3 and the voltage of the fourth node N24 is lowered again.

During the compensation period 2, the first power voltage ELVDD is changed from the low level to the high level and the first control signal GC is applied with the low level at a time P17. Then, the fifth transistor TR25 is turned on to diode-connect the driving transistor TD3.

At this time, because the fourth transistor TR24 remains in a turn on state, the voltage of the second node N2 is changed to the high level of the first power voltage ELVDD.

Next, at a time P18, the third control signal SUS is applied with the high level and the fourth transistor TR24 is turned off. Further, the second control signal GW is applied with the low level and the third transistor TR23 is turned on. Then, the first node N21 and the second node 122 are connected.

Concurrently (e.g., simultaneously), the scan signal scan [i] is applied with the low level and the second transistor TR22 is turned on. Then, the second electrode of the sustain capacitor Chold3 is connected with a signal line of the reference voltage VREF. Accordingly, the data voltage Vdata stored in the sustain capacitor Chold3 is transmitted to the compensation capacitor Cth3. Here, the data voltage Vdata stored in the sustain capacitor Chold3 corresponds to a voltage stored during the scan period 3 of a previous frame.

At this time, the voltage of the second node N22 is changed as described with reference to [Equation 1] above.

Next, at a time P19, the second control signal GW is applied with the high level and the third transistor TR23 is turned off. For example, the first node N21 and the second node N22 are separated or electrically disconnected. Further, the third control signal SUS is applied with the low level and the fourth transistor TR24 is turned on. Then, the voltage of the second node N22 is changed to the high level of the first power voltage ELVDD. The voltage of the third node N23 is changed in substantially the same way as described with reference to [Equation 2] above.

At this time, the scan signal scan[i] is applied with the high level and the fourth control signal SUS4 is applied with the low level. Then, the second transistor TR22 is turned off and the first transistor TR21 is turned on. For example, the first electrode of the sustain capacitor Chold3 is connected with the data line and the second electrode remains in a floating state.

In the light emitting period 4, the second power voltage ELVSS is changed from the high level to the low level at a time P20. Then, a current flows to the organic light emitting diode OLED3 through the driving transistor TD3. A driving current I_OLED flowing to the organic light emitting diode OLED3 is substantially the same as described in [Equation 3] above. When the light emitting period 4 ends, the second power voltage ELVSS is changed to the high level.

Meanwhile, in the scan period 3, the plurality of scan signals scan[1] to scan[n] are sequentially applied to corresponding scan lines with the low level at a time P21. The second transistor TR22 is turned on and the second electrode of the sustain capacitor Chold3 is connected with the signal line of the reference voltage VREF.

At this time, because the first transistor TR21 is in a turn on state, the data voltage Vdata corresponding to the plurality of data signals data[1] to data[m] is stored in the sustain capacitor Chold3. For example, because the first transistor TR21 remains in a turn off state for the initialization period 1 and the compensation period 2, a leakage current path between the first electrode of the sustain capacitor Chold3 and the data line can be blocked. Accordingly, it is possible to prevent the data voltage Vdata stored in the sustain capacitor Chold3 from being lost.

In the bias period 5, the second control signal GW is applied with the low level at a time P22. Then, the third transistor T23 is turned on, and the first node N21 and the second node N22 are connected. Further, the third control signal SUS is changed to the high level and the fourth transistor TR24 is turned off.

At this time, the data signals data[1] to data[m] are transmitted as particular bias voltages Vbias. The bias voltage Vbias may be a voltage having a level lower than the high level of the first power voltage ELVDD and a voltage in a randomly preset level.

For example, the level of the bias voltage Vbias of the driving transistor TD3 can be easily changed by applying the bias voltage Vbias to the driving transistor TD3 by using the data signals data[1] to data[m] instead of changing the first power voltage ELVDD.

Figure 10:
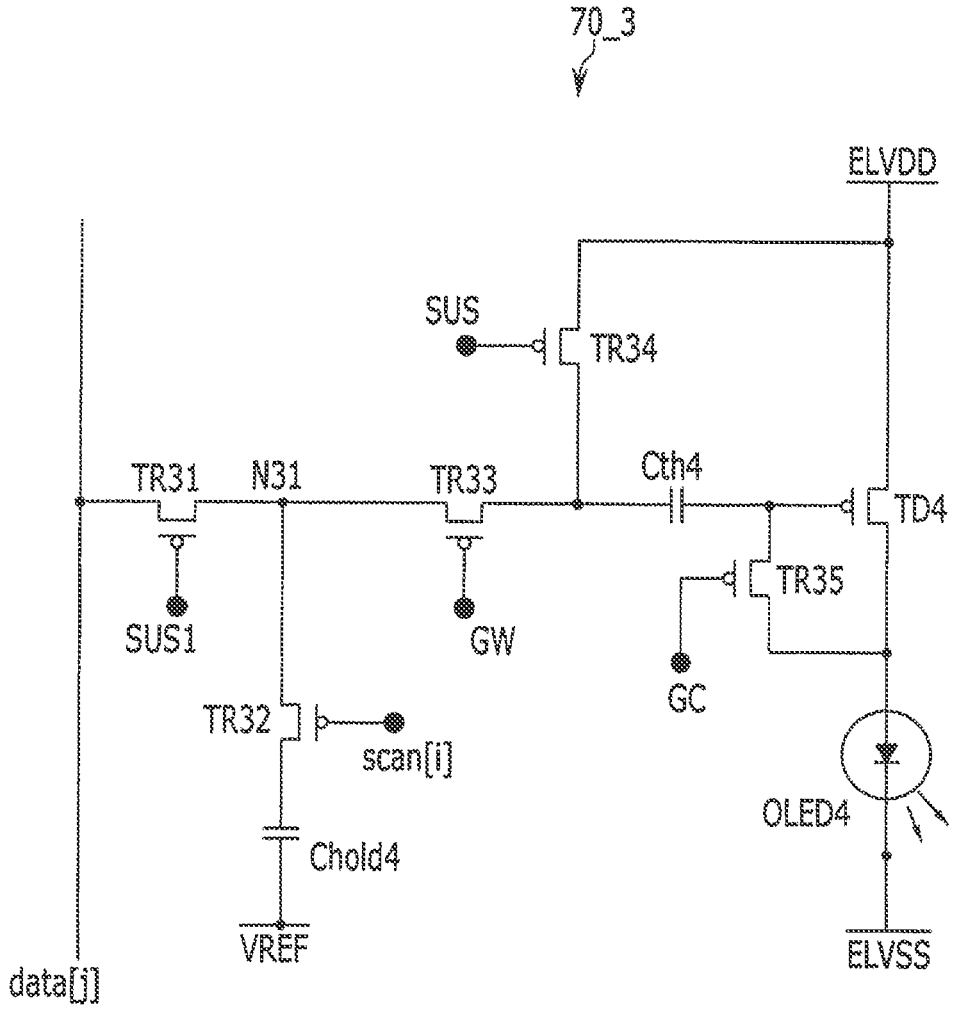
FIG. 10 is a diagram illustrating a pixel circuit according to another exemplary embodiment of the present invention.

FIG. 10 is a diagram illustrating a pixel circuit according to another exemplary embodiment of the present invention.

Referring to FIG. 10, a pixel 70_3 includes first, second, third, fourth, and fifth transistors TR31, TR32, TR33, TR34, and TR35, a driving transistor TD4, a sustain capacitor Chold4, a compensation capacitor Cth4 and an organic light emitting diode OLED4.

The pixel 70_3 illustrated in FIG. 10 differs from FIG. 8 in that positions of the second transistor TR32 and the sustain capacitor Chold4 are exchanged. For example, the second transistor TR32 includes a first electrode connected to a first node N31, a second electrode connected to one terminal of the sustain capacitor Chold4, and a gate electrode to which the scan signal scan[i] is applied. The sustain capacitor Chold4 includes the other terminal to which the reference voltage VREF is applied. Because the remaining components are substantially the same as those of FIG. 8, detailed descriptions thereof will be omitted.

Figure 11:
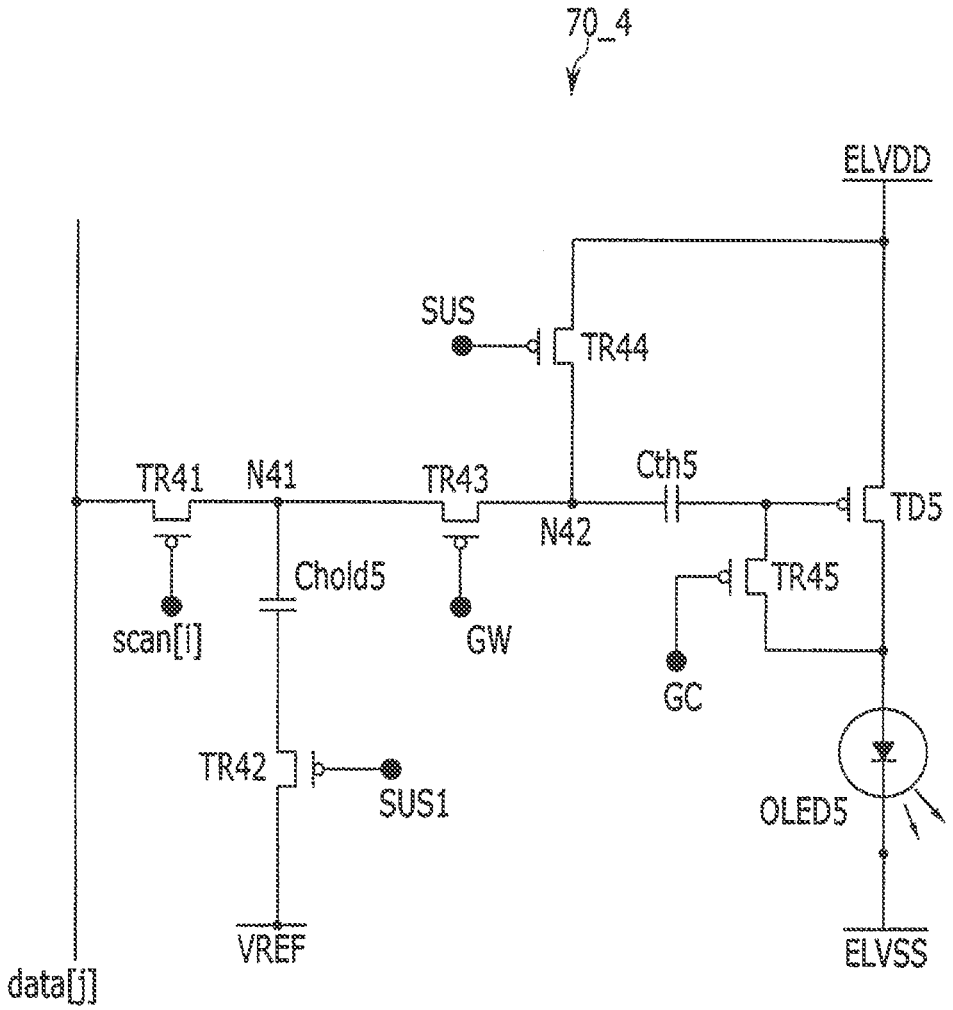
FIG. 11 is a diagram illustrating a pixel circuit according to another exemplary embodiment of the present invention.

Although the method of driving the pixel 703 is substantially the same as the method described in FIG. 9, the second transistor TR32 may be located close to the first and third transistors TR31 and TR33 on a layout, FIG. 11 is a diagram illustrating a pixel circuit according to another exemplary embodiment of the present invention.

Referring to FIG. 11, a pixel 70_4 includes first, second, third, fourth, and fifth transistors TR41, TR42, TR43, TR44, and TR45, a driving transistor TD5, a sustain capacitor Chold5, a compensation capacitor Cth5 and an organic light emitting diode OLED5.

The pixel 70_4 illustrated in FIG. 11 differs from FIG. 8 in that the scan signal scan[i] is applied to a gate terminal of the first transistor TR41 and the fourth control signal SUS1 is applied to a gate terminal of the second transistor TR42. The first transistor TR41 is turned on only during the scan period 3 and the bias period 5 to connect the data line and a first electrode of the sustain capacitor Chold5. The second transistor TR42 is turned off only during the bias period 5 to separate a second electrode of the sustain capacitor Chold5 from a signal line of the reference voltage Vref.

Detailed descriptions thereof will be made with reference to FIG. 12 below.

Figure 12:
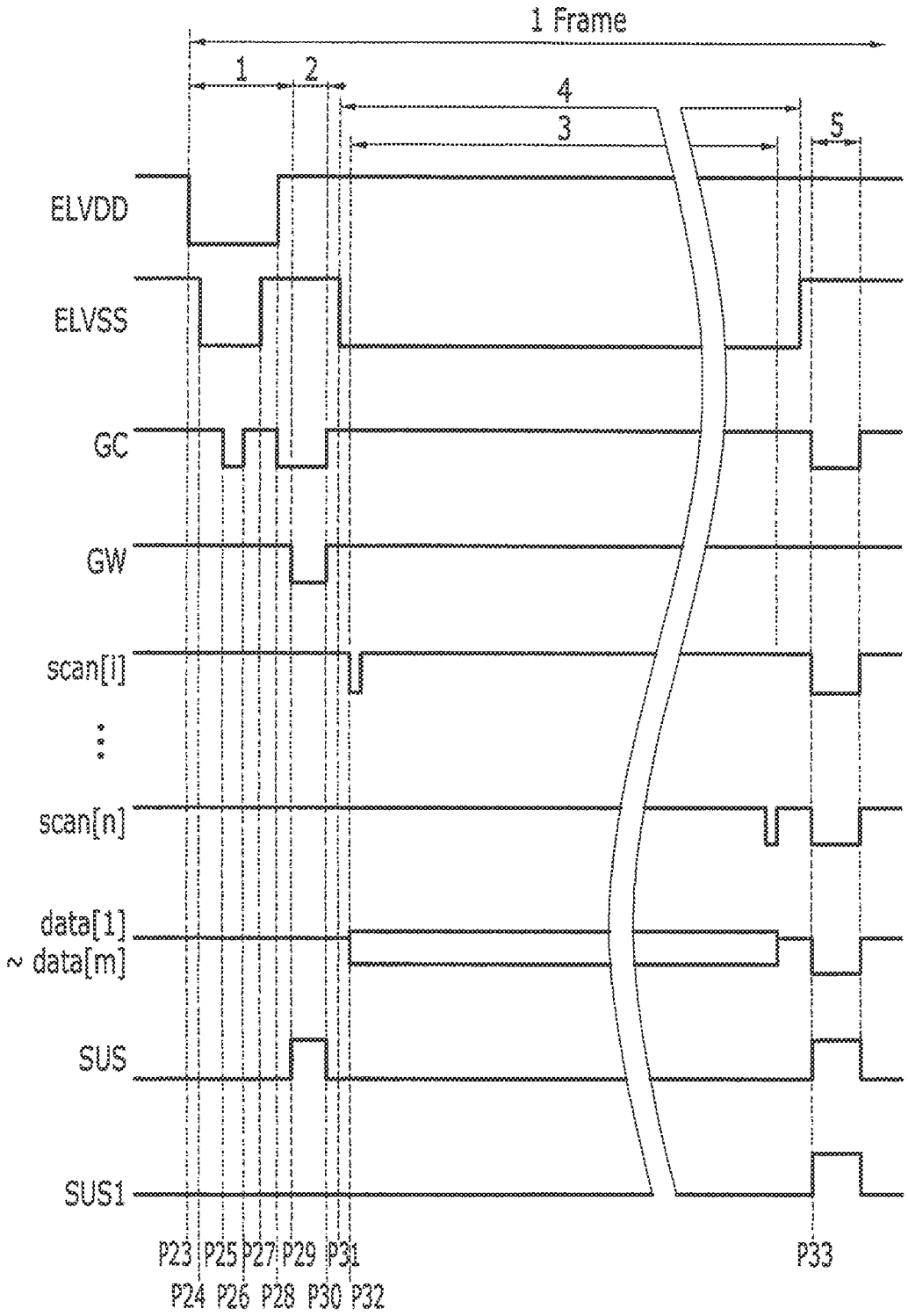
FIG. 12 is a timing diagram illustrating a method of driving an organic light emitting diode display according to another exemplary embodiment of the present invention.

FIG. 12 is a timing diagram illustrating a method of driving an organic light emitting diode display according to another exemplary embodiment of the present invention.

The timing diagram of FIG. 12 shows a method of driving the pixel 70_4 of FIG. 11. Because the first power voltage ELVDD, the second power voltage ELVES, the first control signal GC, the second control signal GW, the data signals data[1] to data[m], and the third control signal SUS have substantially the same waveforms as those of FIG. 9, detailed descriptions thereof will be omitted. The following description will describe the scan signals scan[1] to scan[n] and the fourth control signal SUS1 which are different from those in FIG. 9.

The scan signals scan[1] to scan[n] remain in the high level during the compensation period 2. For example, the first transistor TR41 remains in a turn off state during the initialization period 1 and the compensation period 2, so that a path of a leakage current between a first electrode of the sustain capacitor Chold5 and the data line can be blocked.

Further, the scan signals scan[1] to scan[n] are applied with the low level for the scan period 3 and the bias period 5. For example, at a time 131, the first transistor TR41 is turned on, and the data line and a first node N41 are connected. At this time, because the fourth control signal SUS1 remains in the low level, the second transistor TR42 is turned on, and the data voltage corresponding to the data signals data[1] to data[m] is stored in the sustain capacitor Chold5.

In the bias period 5, the first transistor TR41 is turned on and the data line and the first node N41 are connected at a time P32. At this time, the fourth control signal SUS1 is applied with the high level and the second transistor TR42 is turned off. Accordingly, a second electrode of the sustain capacitor Chold5 becomes in a floating state.

Further, because the second control signal GW is applied with the low level and the third control signal SUS is applied with the high level, the second node N42 is changed to the level of the data signals data[1] to data[m]. At this time, the data signals data[1] to data[m] are applied with the level of the bias voltage.

Figure 13:
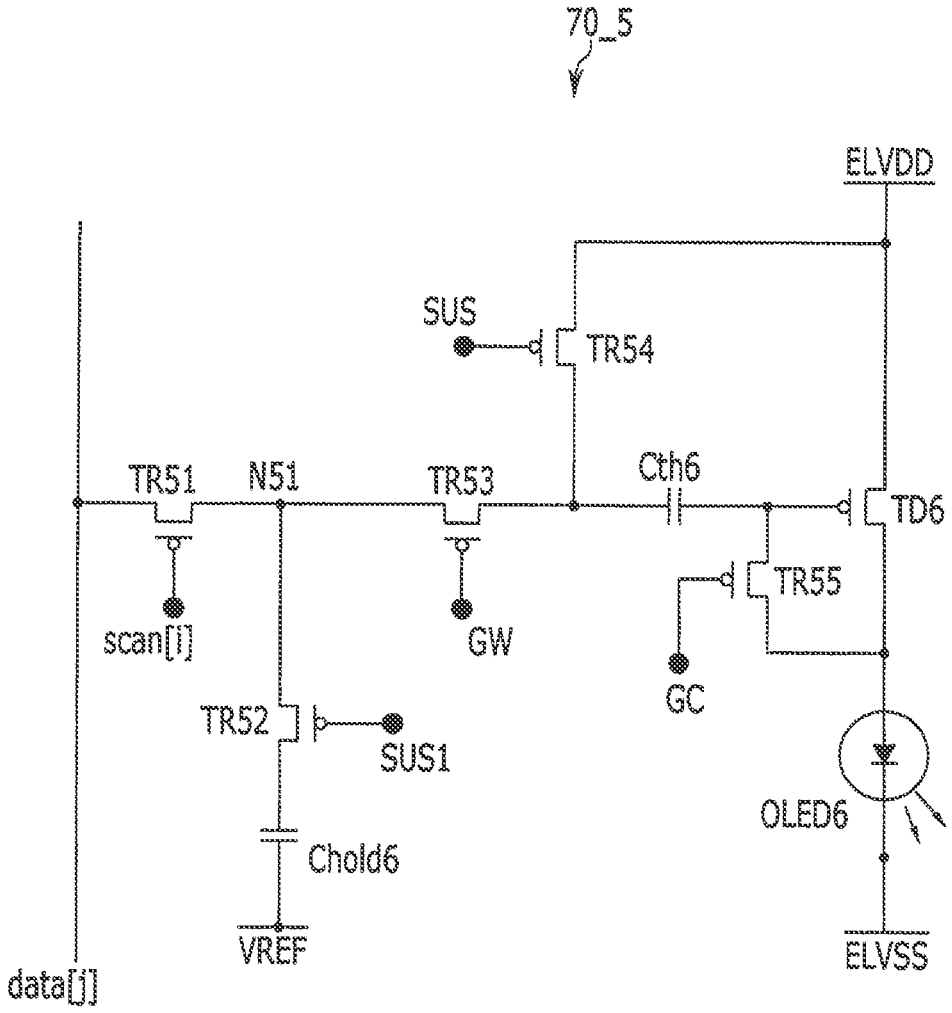
FIG. 13 is a diagram illustrating a pixel circuit according to another exemplary embodiment of the present invention.

FIG. 13 is a diagram illustrating a pixel circuit according to another exemplary embodiment of the present invention.

Referring to FIG. 13, a pixel 70_5 includes first, second, third, fourth, and fifth transistors TR51, TR52, TR53, TR54, and TR55, a driving transistor TD6, a sustain capacitor Chold6, a compensation capacitor Cth6 and an organic light emitting diode OLED6.

The pixel 70_5 illustrated in FIG. 13 differs from FIG. 11 in that positions of the second transistor TR52 and the sustain capacitor Chold6 are exchanged. For example, the second transistor TR52 includes a first electrode connected to a first node 151, a second electrode connected to one terminal of the sustain capacitor Chold6, and a gate electrode to which the fourth control signal SUS1 is applied. The sustain capacitor Chold6 includes the other terminal to which the reference voltage VREF is applied. Because the remaining components are substantially the same as those in FIG. 11, detailed descriptions thereof will be omitted.

Figure 14:
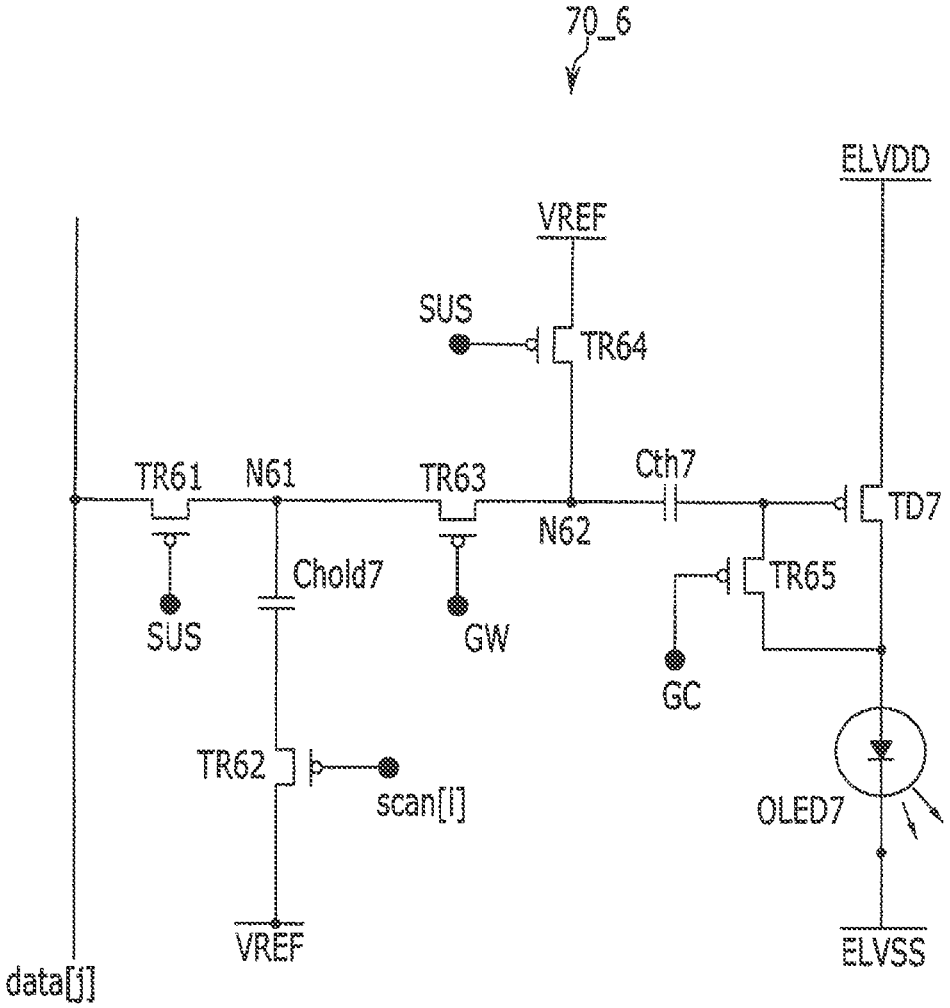
FIG. 14 is a diagram illustrating a pixel circuit according to another exemplary embodiment of the present invention.

FIG. 14 is a diagram illustrating a pixel circuit according to another exemplary embodiment of the present invention.

Referring to FIG. 14, a pixel 70_6 includes first, second, third, fourth, and fifth transistors TR61 TR62, TR63, TR64, and TR65, a driving transistor TD7, a sustain capacitor Chold7, a compensation capacitor Cth7 and an organic light emitting diode OLED7.

The pixel 70_6 illustrated in FIG. 14 differs from FIG. 4 in that a first electrode of the fourth transistor TR64 is connected with a wire of the reference voltage VREF. For example, although a driving method of FIG. 14 is substantially the same as the operation method described in FIG. 5, it differs in that a previous voltage Vn62 of a second node N62 is in the level of the reference voltage VREF, not in the high level of the first power voltage ELVDD at a time P7 . Accordingly, the voltage of the second node N62 is as defined in [Equation 4] below.

$$Vn62=VREF+(V\text{data}-VREF)*\alpha \quad \text{Equation 4}$$

Further, at a time P8 of FIG. 5, a voltage Vn63 of a third node N63 is as defined in [Equation 5] below, $$\begin{aligned} Vn63 &= (ELVDD+Vth)+\beta*(ELVDD-Vn62) \quad \text{Equation 5} \\ &= (1+\beta)*ELVDD+Vth-\beta*Vn62 \\ &= (1+\beta)*ELVDD+Vth-\beta*\{VREF+(Vdata-VREF)*\alpha\} \end{aligned}$$

The pixel 70_6 having the above configuration can be applied to a display panel in which a voltage drop (IR drop) of the first power voltage ELVDD is not huge. Further, in the bias period 5, it is not required to change the data signals data[1] to data[m] by directly applying the reference voltage VREF to the second node N62 instead of applying the data signals data[1] to data[m] with the level of the bias voltage Vbias.

Figure 15:
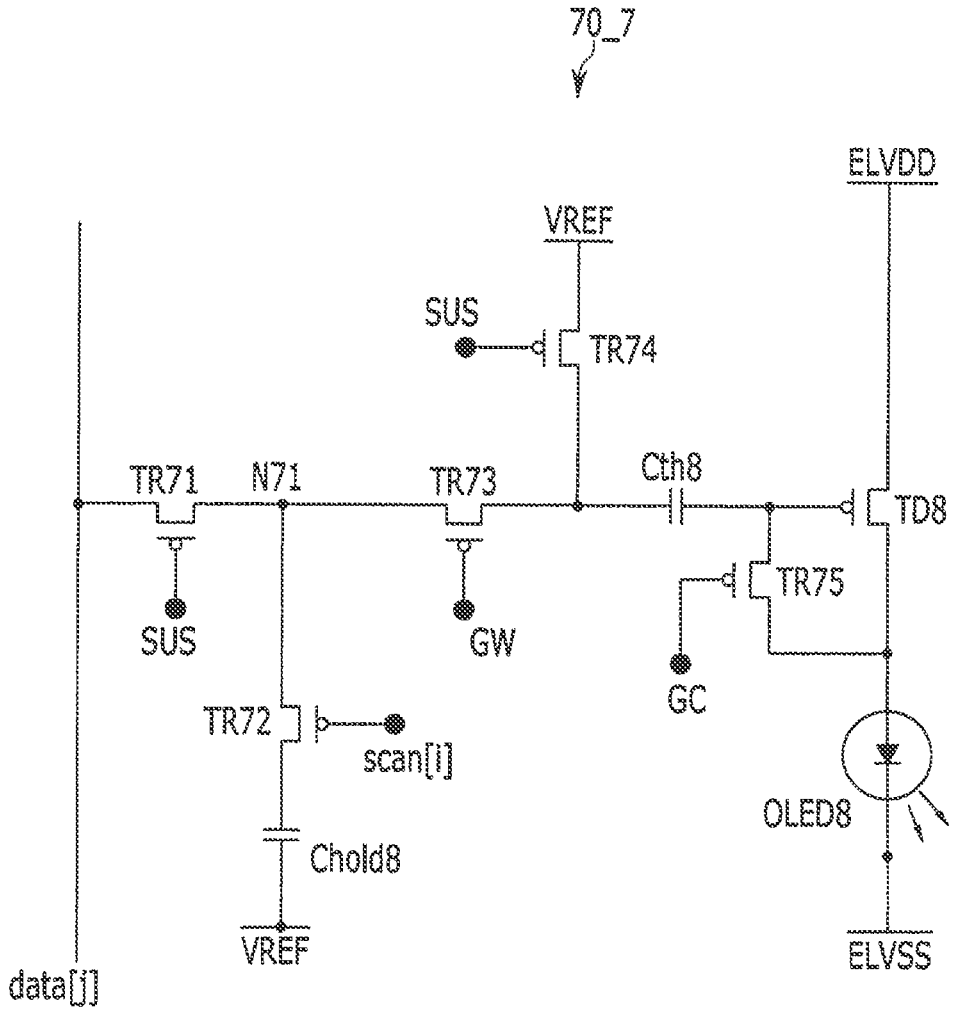
FIG. 15 is a diagram illustrating a pixel circuit according to another exemplary embodiment of the present invention.

FIG. 15 is a diagram illustrating a pixel circuit according to another exemplary embodiment of the present invention.

Referring to FIG. 15, a pixel 70_7 includes first, second, third, fourth, and fifth transistors TR71, TR72, TR73, TR74, and TR75, a driving transistor TD8, a sustain capacitor Chold8, a compensation capacitor Cth8 and an organic light emitting diode OLED8.

The pixel 70_7 illustrated in HG, 15 differs from FIG. 14 in that positions of the second transistor TR72 and the sustain capacitor Chold8 are exchanged. For example, the second transistor TR72 includes a first electrode connected to a first node N71, a second electrode connected to one terminal of the sustain capacitor Chold8, and a gate electrode to which the scan signal scan[i] is applied. The sustain capacitor Chold8 includes the other terminal to which the reference voltage VREF is applied.

Because the remaining components are substantially the same as those in FIG. 14, detailed descriptions thereof will be omitted.

Figure 16:
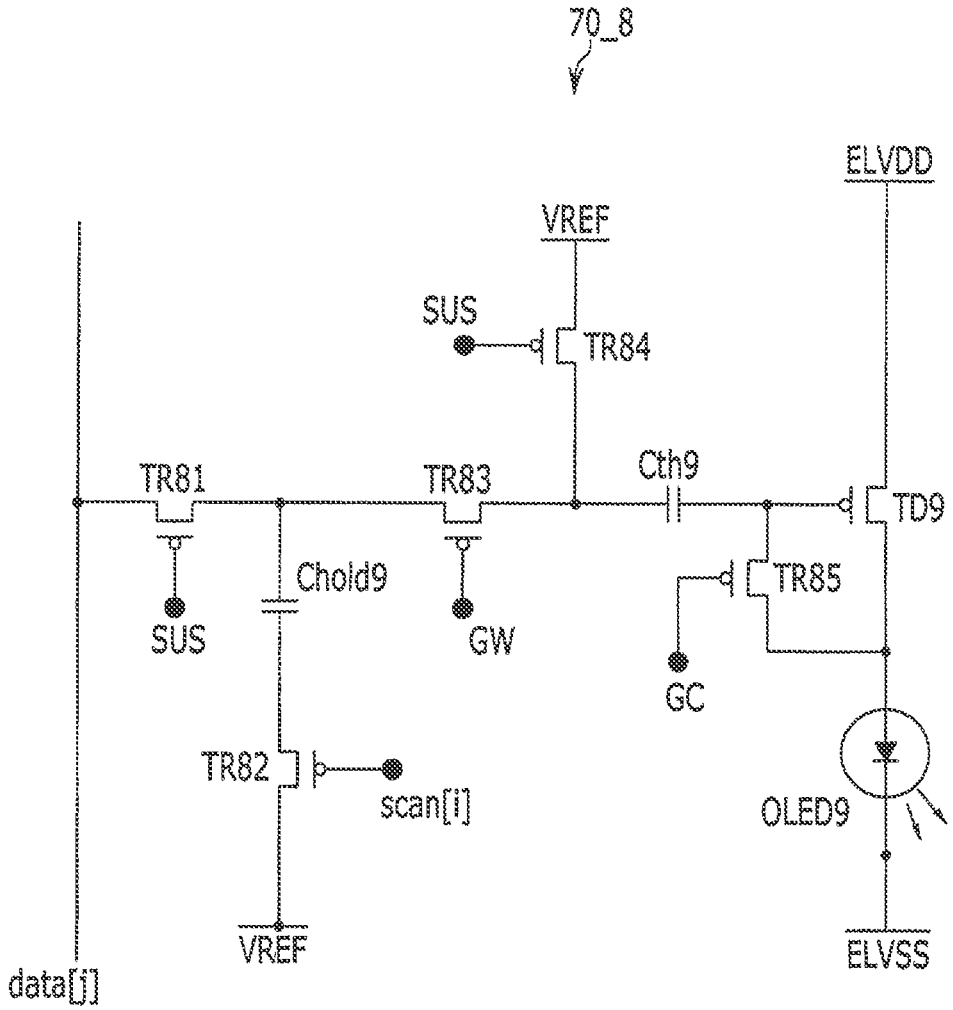
FIG. 16 is a diagram illustrating a pixel circuit according to another exemplary embodiment of the present invention.

FIG. 16 is a diagram illustrating a pixel circuit according to another exemplary embodiment of the present invention.

Referring to FIG. 16, a pixel 70_8 includes first, second, third, fourth, and fifth transistors TR81, TR82, TR83, TR84, and TR85, a driving transistor TD9, a sustain capacitor Chold9, a compensation capacitor Cth9 and an organic light emitting diode OLED9.

The pixel 70_8 illustrated ire FIG. 16 differs from FIG. 8 in that a first electrode of the fourth transistor TR84 is connected with a wire of the reference voltage VREF. Because the remaining components are substantially the same as those in FIG. 8, detailed descriptions thereof will be omitted.

Figure 17:
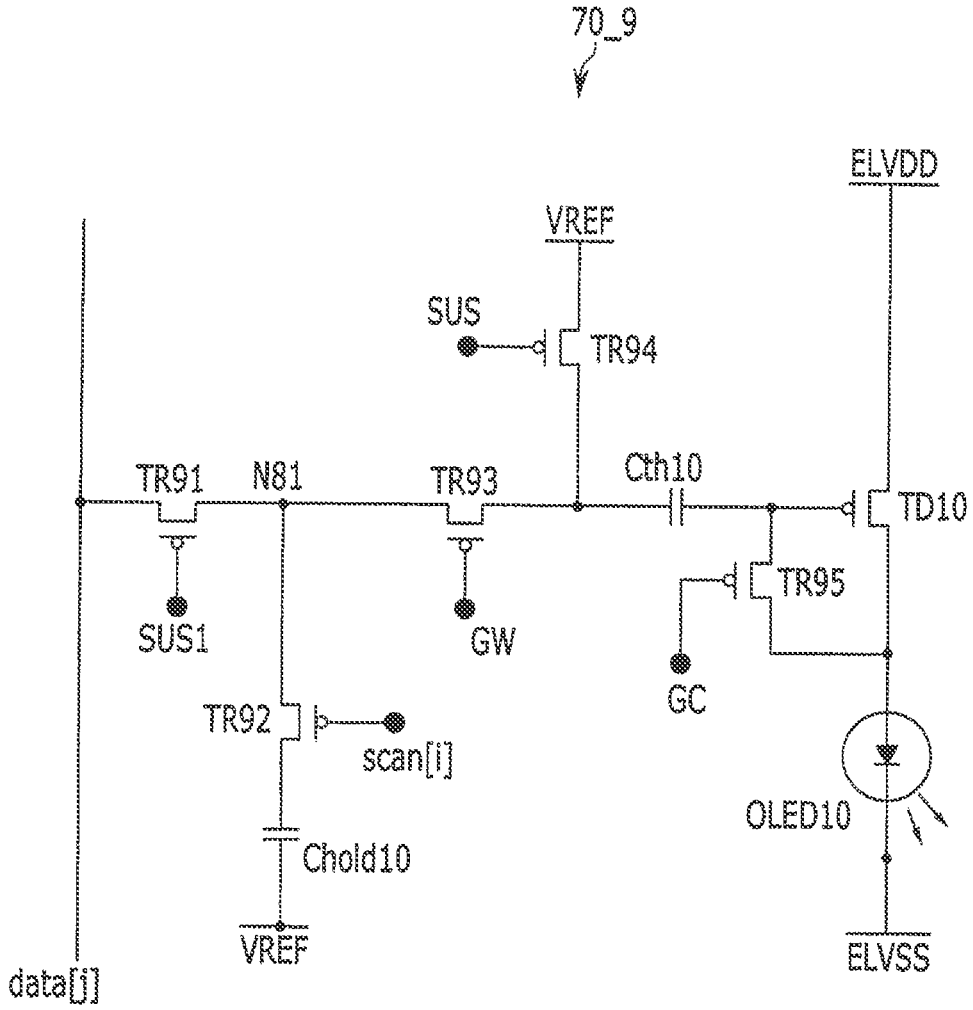
FIG. 17 is a diagram illustrating a pixel circuit according to another exemplary embodiment of the present invention.

FIG. 17 is a diagram illustrating a pixel circuit according to another exemplary embodiment of the present invention.

Referring to FIG. 17, a pixel 70_9 includes first, second, third, fourth, and fifth transistors TR91, TR92, TR93, TR94, and TR95, a driving transistor TD10, a sustain capacitor Chold10, a compensation capacitor Cth10 and an organic light emitting diode OLED10.

The pixel 70_9 illustrated in FIG. 17 differs from FIG. 16 in that positions of the second transistor TR92 and the sustain capacitor Chold10 are exchanged. For example, the second transistor TR92 includes a first electrode connected to a first node N81, a second electrode connected to one terminal of the sustain capacitor Chold10, and a gate electrode to which the scan signal scan[i] is applied. The sustain capacitor Chold10 includes the other terminal to which the reference voltage VREF is applied. Because the remaining components are substantially the same as those in FIG. 16, detailed descriptions thereof will be omitted.

Figure 18:
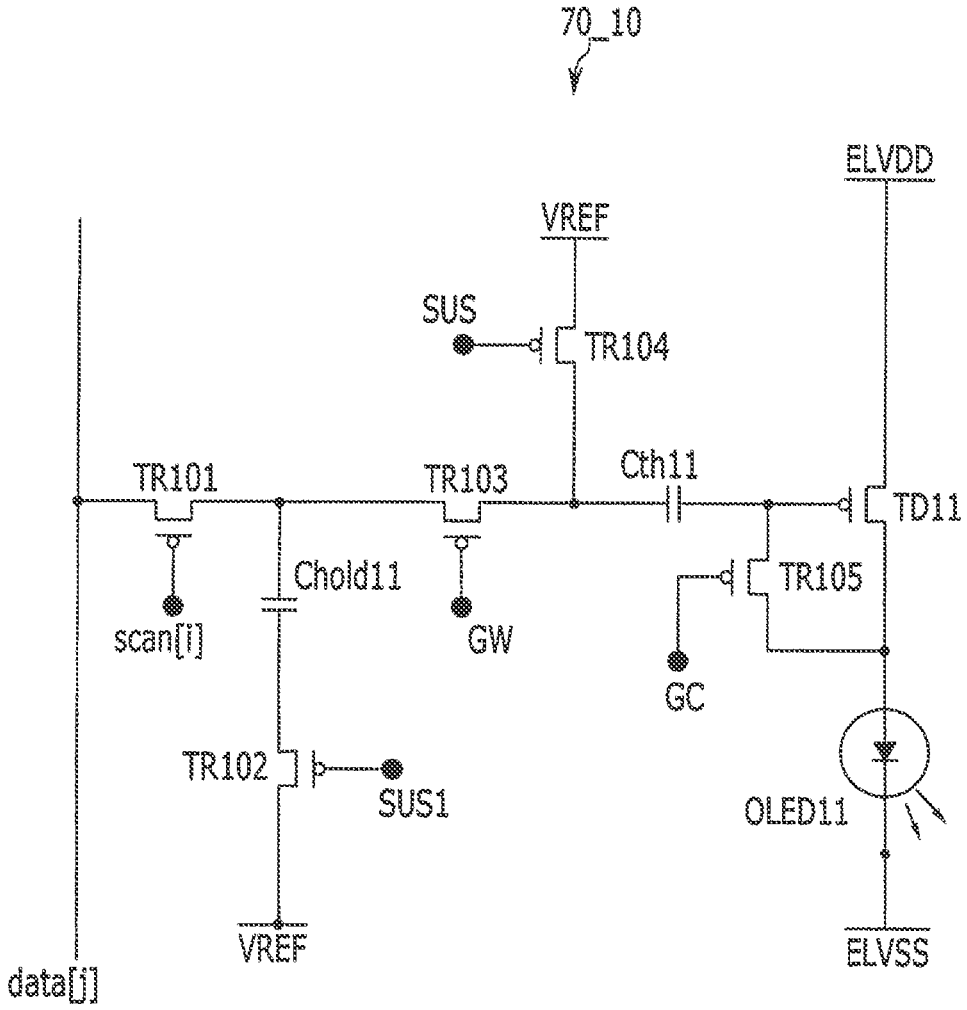
FIG. 18 is a diagram illustrating a pixel circuit according to another exemplary embodiment of the present invention.

FIG. 18 is a diagram illustrating a pixel circuit according to another exemplary embodiment of the present invention.

Referring to FIG. 18, a pixel 70_10 includes first, second, third, fourth, and fifth transistors TR101, TR102, TR103, TR104, and TR105, a driving transistor TD11, a sustain capacitor Chold11, a compensation capacitor Cth11 and an organic light emitting diode OLED11.

The pixel 70_10 illustrated in FIG. 18 differs from FIG. 11 in that a first electrode of the fourth transistor TR104 is connected with a wire of the reference voltage VREF. Because the remaining components are substantially the same as those in FIG. 11, detailed description thereof will be omitted.

Figure 19:
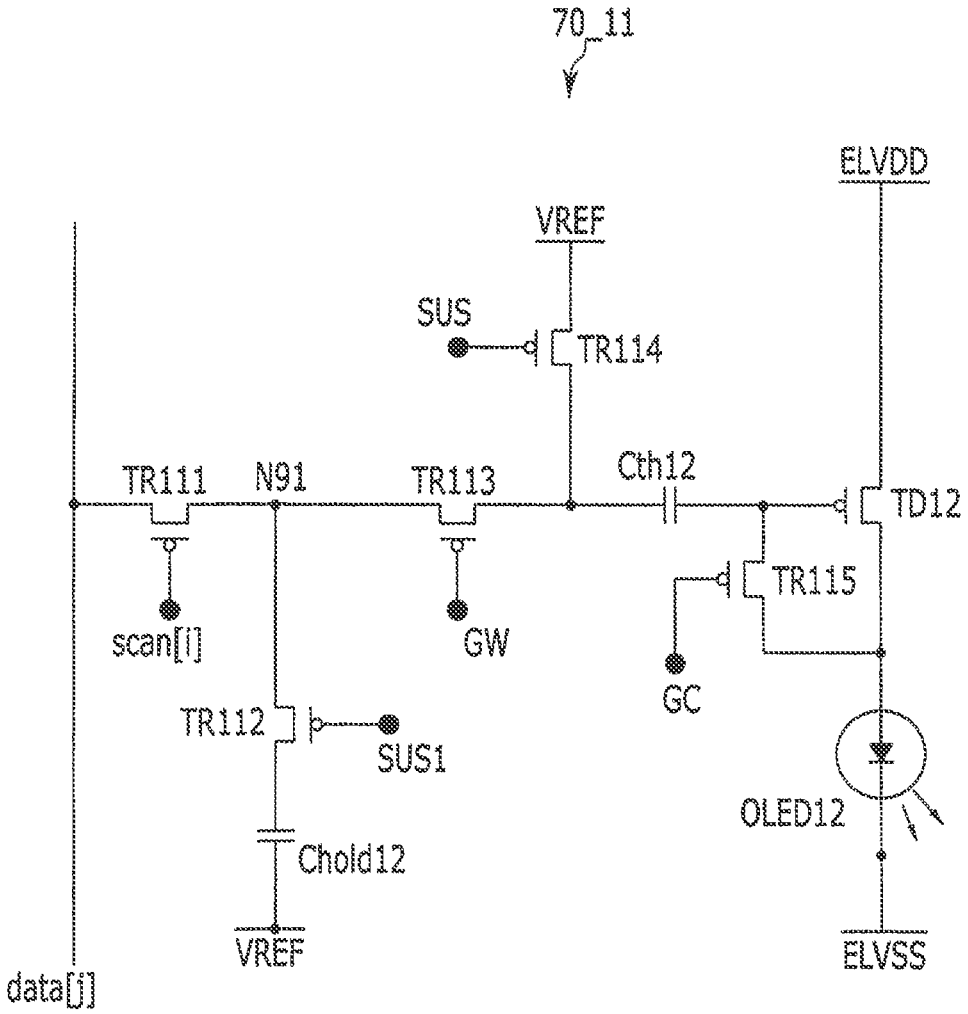
FIG. 19 is a diagram illustrating a pixel circuit according to another exemplary embodiment of the present invention.

FIG. 19 is a diagram illustrating a pixel circuit according to another exemplary embodiment of the present invention.

Referring to FIG. 19, a pixel 70_11 includes first, second, third, fourth, and fifth transistors TR111, TR112, TR113, TR114, and TR115, a driving transistor TD12, a sustain capacitor Chold12, a compensation capacitor Cth12 and an organic light emitting diode OLED12.

The pixel 70_11 illustrated in FIG. 19 differs from FIG. 18 in that positions of the second transistor TR112 and the sustain capacitor Chold12 are exchanged. For example, the second transistor TR112 includes a first electrode connected to a first node N91, a second electrode connected to one terminal of the sustain capacitor Chold12, and a gate electrode to which the fourth control signal SUS1 is applied. The sustain capacitor Chold12 includes the other terminal to which the reference voltage VREF is applied. Because the remaining components are substantially the same as those in FIG. 18, detailed descriptions thereof will be omitted.

As described above, the pixel according to an exemplary embodiment of the present invention can sufficiently secure (or improve) an aperture ratio by emitting light by using one compensation capacitor Cth connected to the gate electrode of the driving transistor TD for the light emitting period 4 and store a data voltage corresponding to capacitance of the compensation capacitor Cth.

Further, the pixel according to an exemplary embodiment of the present invention can prevent (or reduce an effect of) a screen from being non-uniformly displayed due to a change in the first power voltage ELVDD by changing the data signals data[1] to data[m] to apply the bias voltage Vbias to the second node N2.

While this invention has been described in connection with what is presently considered to be practical exemplary embodiments, it is to be understood that the invention is not limited to the disclosed embodiments, but, on the contrary, is intended to cover various modifications and equivalent arrangements within the spirit and scope of the appended claims and equivalents thereof.

What is claimed is:

1. An organic light emitting diode display comprising:

a plurality of pixels configured to store a first data signal received through a corresponding data line during a scan period and to emit light according to a second data signal during a light emitting period of a frame, wherein the first data signal corresponds to the frame and the second data signal corresponds to a previous frame, and the scan period overlaps the light emitting period, and each of the plurality of pixels comprising:

a first transistor configured to connect the data line and a first node;

a sustain capacitor coupled between the first node and a reference voltage applying line;

a third transistor configured to connect the first node and a second node;

a driving transistor and an organic light emitting diode connected in series between first and second power voltage applying lines;

a compensation capacitor connected between the second node and a gate electrode of the driving transistor, the compensation capacitor and the third transistor being connected in series between the first node and the gate electrode of the driving transistor;

a second transistor configured to connect the sustain capacitor and the reference voltage applying line; and a fourth transistor configured to transmit a bias voltage to the second node.

2. The organic light emitting diode display of claim 1, wherein:

the first data signal is a data signal at a first time or a data signal at a second time corresponding to the frame, the second data signal is an image data signal at a first time or a data signal at a second time corresponding to the previous frame, and the times of the first data signal and the second data signal are different from each other.

3. The organic light emitting diode display of claim 1, wherein the frame comprises:

an initialization period during which a drain electrode of the driving transistor is reset and initialized;

a compensation period during which a threshold voltage of the driving transistor is compensated for;

the scan period during which a voltage corresponding to the first data signal is stored in the sustain capacitor when a scan signal is applied through a scan line coupled to a pixel of the pixels;

the light emitting period during which the organic light emitting diode emits light according to a driving current corresponding to the second data signal when the bias voltage is applied to the second node; and a bias period during which the driving transistor is driven according to the bias voltage.

4. The organic light emitting diode display of claim 3, wherein the second transistor is configured to connect the sustain capacitor and the reference voltage applying line during the compensation period and the scan period.

5. The organic light emitting diode display of claim 3, wherein the sustain capacitor is connected between the first node and the second transistor.

6. The organic light emitting diode display of claim 3, wherein the sustain capacitor is configured to store the voltage corresponding to the first data signal from the scan period of the previous frame until the initialization period of the frame.

7. The organic light emitting diode display of claim 6, wherein the third transistor is configured to transmit the voltage stored in the sustain capacitor to the compensation capacitor during the compensation period.

8. The organic light emitting diode display of claim 7, wherein the compensation capacitor is configured to store the voltage corresponding to the second data signal from the compensation period of the previous frame until the initialization period of the frame.

9. The organic light emitting diode display of claim 8, wherein the fourth transistor is configured to connect the second node and the first power voltage applying line when the first power voltage and the second power voltage are applied with a first level during the initialization period.

10. The organic light emitting diode display of claim 8, wherein the fourth transistor is configured to block transmission of the bias voltage to the second node during the compensation period.

11. The organic light emitting diode display of claim 3, wherein the first transistor is configured to electrically disconnect the data line and the first node during the compensation period.

12. The organic light emitting diode display of claim 3, wherein each of the plurality of pixels further comprises a fifth transistor configured to diode-connect a gate electrode and a drain electrode of the driving transistor when the first power voltage and the second power voltage are applied with the first level during the initialization period.

13. The organic light emitting diode display of claim 12, wherein the fifth transistor is configured to diode-connect the gate electrode and the drain electrode of the driving transistor when the first power voltage and the second power voltage are applied with a second level higher than the first level during the compensation period.

14. The organic light emitting diode display of claim 12, wherein the fifth transistor is configured to diode-connect the gate electrode and the drain electrode of the driving transistor when the first power voltage and the second power voltage are applied with a second level during the bias period.

15. The organic light emitting diode display of claim 12, wherein the first and third transistors are configured to be turned on, the fourth transistor is configured to be turned off, and the bias voltage is transmitted to the second node through the data line during the bias period.

16. A method of driving an organic light emitting diode display comprising a plurality of pixels each comprising a first transistor configured to connect a data line and a first node, a sustain capacitor coupled between the first node and a reference voltage applying line, a third transistor configured to connect the first node and a second node, a driving transistor and an organic light emitting diode connected in series between first and second power voltage applying lines, a compensation capacitor connected between the second node and a gate electrode of the driving transistor, the compensation capacitor and the third transistor being connected in series between the first node and the gate electrode of the driving transistor, a second transistor configured to connect the sustain capacitor and the reference voltage applying line, and a fourth transistor configured to transmit a bias voltage to the second node, the method comprising:

storing a first data signal corresponding to a frame in the sustain capacitor during a scan period; and emitting light from the organic light emitting diode in accordance with a second data signal corresponding to a previous frame during a light emitting period, wherein the scan period and a light emitting period occur concurrently.

17. The method of driving an organic light emitting diode display of claim 16, further comprising:

resetting and initializing a drain electrode of the driving transistor;

compensating for a threshold voltage of the driving transistor; and driving the driving transistor according to the bias voltage.

18. The method of driving an organic light emitting diode display of claim 17, wherein emitting the light comprises emitting the organic light emitting diode with the driving current corresponding to a voltage stored in the compensation capacitor when the first power voltage or the reference voltage is transmitted to the second node.

* * * * *